US007038394B2

(12) United States Patent
Yamashita

(10) Patent No.: US 7,038,394 B2
(45) Date of Patent: May 2, 2006

(54) RAMP VOLTAGE GENERATING APPARATUS AND ACTIVE MATRIX DRIVE-TYPE DISPLAY APPARATUS

(75) Inventor: Atsuhiro Yamashita, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 45 days.

(21) Appl. No.: 10/950,475

(22) Filed: Sep. 28, 2004

(65) Prior Publication Data

US 2005/0067968 A1 Mar. 31, 2005

(30) Foreign Application Priority Data

Sep. 29, 2003 (JP) ..... 2003-338241
Mar. 29, 2004 (JP) ..... 2004-094813

(51) Int. Cl.
*G09G 3/10* (2006.01)
*G09G 5/00* (2006.01)
*G05F 1/00* (2006.01)

(52) U.S. Cl. ..... 315/169.3; 315/169.2; 315/169.4; 315/291; 315/307; 345/4; 345/76; 345/211; 345/204

(58) Field of Classification Search ..... 315/169.2, 315/169.3, 169.4, 291, 307; 345/4, 76, 204, 345/211

See application file for complete search history.

(56) References Cited

U.S. PATENT DOCUMENTS

| | | | | |
|---|---|---|---|---|
| 6,697,057 | B1 * | 2/2004 | Koyama et al. | 345/204 |
| 2004/0095306 | A1 * | 5/2004 | Fujiyoshi | 345/94 |
| 2004/0227743 | A1 * | 11/2004 | Brown | 345/204 |
| 2005/0052447 | A1 * | 3/2005 | Ishiyama | 345/211 |
| 2005/0093958 | A1 * | 5/2005 | Mori et al. | 347/207 |
| 2005/0225518 | A1 * | 10/2005 | Yamada et al. | 345/77 |

FOREIGN PATENT DOCUMENTS

| | | |
|---|---|---|
| JP | 10-312173 | 11/1998 |
| JP | 2002-202746 | 7/2002 |
| JP | 2003-241711 | 8/2003 |

* cited by examiner

*Primary Examiner*—Trinh Dinh
*Assistant Examiner*—Tung Le
(74) *Attorney, Agent, or Firm*—McDermott Will & Emery LLP

(57) ABSTRACT

A ramp voltage generating apparatus according to the present invention includes a ramp voltage generating circuit for generating a plurality of ramp voltages out of phase with each other from one ramp voltage, and a control circuit. The ramp voltage generating circuit includes a plurality of voltage generating circuit portions connected in parallel to a voltage input terminal. Each voltage generating circuit portion includes a voltage output terminal, a capacitor, an operational amplifier, a first switch, a second switch and a third switch. The control circuit turns on the third switches while shifting the time point of switching each of the third switches from off to on state, and the control circuit turns off the first switches and, also, turns on the second switches during the period including the fall time point of the ramp voltage input to the voltage input terminal.

11 Claims, 19 Drawing Sheets

One frame
nH

RAMP-IN
1H
SCAN1
=SCAN-IN1

SCAN2
=SCAN-IN2
SCAN3
=SCAN-IN3

P1
P2

RAMP-
OUT1
Vs
RAMP-
OUT2
Vs
RAMP-
OUT3
Vs nH

RAMP-IN
1H 1H 1H

SCAN1
SCAN2
SCAN3

SCAN-IN1
SCAN-IN2

P1
P2

RAMP-OUT1
RAMP-OUT2

One frame
nH

RAMP -IN
1H

SCAN1
SCAN2

SCAN-IN1
SCAN-IN2

P1
P2

V1
Vc
Vs

RAMP-OUT1
Vc
Vs
RAMP-OUT2
Vc
Vs

T1
T2
T3
T4
T5

RAMP-IN

SCAN1

SCAN-IN1

P1
P2
Hi
Lo

V1
Vc
Vs

RAMP-OUT1
Vc
Vs

One frame
nH

RAMP-IN
1H

SCAN1
SCAN2

SCAN-IN1A
SCAN-IN1B
SCAN-IN2A
SCAN-IN2B

P1
P2

RAMP-OUT1
Vc
Vs
RAMP-OUT2
Vc
Vs

RAMP VOLTAGE GENERATING APPARATUS AND ACTIVE MATRIX DRIVE-TYPE DISPLAY APPARATUS

This application is based on Japanese Patent Application No. 2003-338241 filed on Sep. 29, 2003 and Japanese Patent Application No. 2004-094813 filed on Mar. 29, 2004, the contents of which are hereby incorporated by reference.

BACKGROUND OF THE INVENTION

1. Field of the Invention

The present invention relates to a ramp voltage generating apparatus having a ramp voltage generating circuit for generating a plurality of ramp voltages out of phase with each other, and an active matrix drive-type display apparatus.

2. Description of the Prior Art

In recent years, an organic electroluminescence display (hereinafter, referred to as "organic EL display", and a display apparatus using the organic EL display as "organic EL display apparatus") has been under development. Use of the organic EL display for a mobile telephone, for example, is being studied.

As a method of driving the organic EL display, there have been known a passive matrix drive type for driving the organic EL display in a time-division manner by using a scanning electrode and a data electrode, and an active matrix drive type for maintaining luminescence of each pixel over one vertical scanning period.

In the active matrix drive-type organic EL display, as shown in FIG. 13, each pixel 41 includes an organic EL element 40, a drive transistor TR2 for controlling on/off state of the organic EL element 40, a write transistor TR1 turning on in response to application thereto of a scanning voltage SCAN from a scanning electrode, and a capacitor C fed with a data voltage DATA from a data electrode when the write transistor TR1 is in the on state, wherein the output voltage of the capacitor C is applied to the gate of the drive transistor TR2.

First, a voltage is applied sequentially to the scanning electrodes, so that the plurality of write transistors TR1 connected to the same scanning electrode are turned on. Then, each data electrode is supplied with the data voltage (input signal) in synchronism with the scanning operation. Herein, the write transistor TR1 is in an on state; therefore, electric charges corresponding to the data voltage are accumulated in the capacitor C.

Next, an operating state of the drive transistor TR2 is determined by an amount of the electric charges accumulated in the capacitor C. When the drive transistor TR2 is turned on, a current of the magnitude corresponding to the data voltage is supplied to the organic EL element 40 through the drive transistor TR2. As a result, the organic EL element 40 is lighted with the luminosity corresponding to the data voltage. This lighted state is held over one vertical scanning period.

As described above, the analog drive-type organic EL display, in which the organic EL element 40 is supplied with a current corresponding to the magnitude of the data voltage and is thus lighted with the luminosity corresponding to the data voltage, has a problem of display irregularities. In an attempt to solve this problem, a digital drive-type organic EL display apparatus for expressing multiple tones by supplying the organic EL element with a pulse current having a duty ratio corresponding to the data voltage is disclosed in Japanese Patent Application Laid-Open No. H10-312173.

FIG. 14 shows a digital drive-type organic EL display apparatus proposed by the present applicant. This digital drive-type organic EL display apparatus is disclosed in Japanese Patent Application Laid-Open No. 2003-241711 (hereinafter, referred to as "Patent Document 1"). As shown in FIG. 14, an organic EL display 10 includes a display panel 4 composed of arrangement of a plurality of pixels in a matrix, and a scanning driver 2 and a data driver 3 connected to the display panel 4. The video signal supplied from a video source such as a TV receiver (not shown) is supplied to a video signal processing circuit 6 and is processed as required for image display. The resulting video signal of three primary colors RGB is supplied to the data driver 3 of the organic EL display 10.

A horizontal sync (synchronizing) signal Hsync and a vertical sync signal Vsync obtained from the video signal processing circuit 6 are supplied to a timing signal generating circuit 70, whereby a timing signal is supplied to the scanning driver 2 and the data driver 3.

Further, the timing signal obtained from the timing signal generating circuit 70 is supplied to the ramp voltage generating circuit 80, whereby, as described later, a ramp voltage used for driving the organic EL display 10 is generated and, then, is supplied to each pixel of the display panel 4.

The display panel 4 is composed of a matrix arrangement of pixels 42 having a circuit configuration as shown in FIG. 15. Each pixel 42 includes an organic EL element 40, a drive transistor TR2 for turning on/off the organic EL element 40 in accordance with the input of the on/off control signal to the gate thereof, a write transistor TR1 turned on upon application to the gate thereof of a scanning voltage from the scanning driver 2, a capacitor C fed with a data voltage from the data driver 3 when the write transistor TR1 is in an on state, and a comparator 43 for comparing a ramp voltage supplied from a ramp voltage generating circuit 80 and an output voltage of the capacitor C with each other, both the ramp voltage and the output voltage of the capacitor C being supplied to a pair of positive and negative input terminals of the comparator 43. The output signal of the comparator 43 is supplied to the gate of the drive transistor TR2.

A source of the drive transistor TR2 is connected with a current supply line 44, and the drain of the drive transistor TR2 is connected to the organic EL element 40. One of the electrodes (e.g., source) of the write transistor TR1 is connected to the data driver while the other electrode (e.g., drain) of the write transistor TR1 is connected to an end of the capacitor C and, also, to an inverted input terminal of the comparator 43. A non-inverted input terminal of the comparator 43 is connected with an output terminal of the ramp voltage generating circuit 80.

In the above organic EL display apparatus, as shown in FIG. 16A, one frame period is divided into a first-half scanning period and a second-half luminescence period.

During the scanning period, in a horizontal line, the write transistor TR1 constituting each pixel 42 is turned on by the scanning voltage applied from the scanning driver, so that the data voltage from the data driver is applied to and accumulated as electric charges in the capacitor C. As a result, one frame of data are set in all the pixels constituting the organic EL display apparatus.

The ramp voltage generating circuit 80, as shown in FIG. 16B, maintains a H-level voltage value during the first half, i.e., the scanning period of each one frame period, and a ramp voltage changing linearly from a L- to H-level voltage value is generated during the second half, i.e., the luminescence period.

During the first half period, i.e., the scanning period, the H-level voltage from the ramp voltage generating circuit is applied to the non-inverted input terminal of the comparator 43, so that the output of the comparator 43 always remain at H level as shown in FIG. 16C regardless of the voltage input to the inverted input terminal.

During the second half, i.e., the luminescence period, on the other hand, at the same time that the ramp voltage from the ramp voltage generating circuit is applied to the non-inverted input terminal of the comparator 43, the output voltage (data voltage) of the capacitor C is applied to the inverted input terminal of the comparator 43, so that the output of the comparator 43 takes either H or L value in accordance with the result of comparison between the two voltages as shown in FIG. 16C. Specifically, as long as the ramp voltage is lower than the data voltage, the output of the comparator 43 is at L level, while the output of the comparator 43 is at H level during the period when the ramp voltage is higher than the data voltage. The length of the period during which the output of the comparator 43 is at L level is proportional to the magnitude of the data voltage and may be different for a different pixel.

In this way, the output of the comparator 43 remains at L level only during the period when it is proportional to the magnitude of the data voltage. Thus, the drive transistor TR2 remains on during the same period, thereby turning on the power supplied to the organic EL element 40.

As a result, the organic EL element 40 of each pixel 42 emits light only during the period proportional to the data voltage for each pixel 42 in each frame period, thereby realizing the multitone expression.

In the organic EL display apparatus shown in FIG. 14, however, the luminescence is controlled in accordance with the data during the second half, i.e., the luminescence period after the data is written during the first half, i.e., the scanning period for all the pixels constituting the display panel 4, and therefore a high-speed scan operation is required. In the case where the scanning speed is low, the luminescence period is so short that an excessive peak current flows in the organic EL element, thereby increasing the effect of the voltage drop of the power line in the display panel.

In view of this, the present applicant has proposed an organic EL display apparatus in which the phase of the ramp voltage is shifted for each horizontal line as shown in FIG. 18, so that the light is emitted for each horizontal line immediately after the data is written for each horizontal line (Patent Document 1).

In this organic EL display apparatus, as shown in FIG. 17, the ramp voltage as a digital signal output from the ramp voltage generating circuit 80 is applied to each pixel of each horizontal line through a delay circuit 81 and a D/A converter 82 for each horizontal line. As a result, the phase of the ramp voltage supplied to each horizontal line, as shown in FIG. 18, is shifted by a predetermined delay time for every line from the first to the last. Incidentally, the data supplied from the data driver 3 is written immediately before the ramp voltage for each horizontal line increases.

With the organic EL display apparatus described above, all the horizontal lines can be scanned by consuming almost the entire frame period constituting the display period of one screen, and therefore no high-speed scan is required. Also, the ramp voltage curve for each horizontal line has a gentle inclination from L to H level over one frame period. In this way, substantially the whole of one frame period can be used as a luminescence period.

On the other hand, an organic EL display apparatus having the waveform generator shown in FIG. 19 is disclosed in Japanese Patent Application Laid-Open No. 2002-202746.

The waveform generator, which is for generating the ramp voltage changing in the sawtooth waveform from the clock pulse, is composed of two capacitors C11, C12, three switching elements SWa, SWb, SWc, an operational amplifier 83 having the gain of unity, and a low-pass filter 84 including one resistor R and one capacitor C13.

In the waveform generator, the three switching elements SWa, SWb, SWc are turned on/off, so that the output voltage changing in steps is produced from the operational amplifier 83. This output voltage is supplied to the low-pass filter 84 thereby to produce a ramp voltage changing in the shape of sawtooth wave.

In the organic EL display apparatus shown in FIG. 17, however, the provision of the D/A converter 82 for each horizontal line and the delay circuit 81 for each of the second to last lines poses the problem that the circuit configuration is complicated.

An configuration of the organic EL display apparatus is conceivable in which the waveform generator of FIG. 19 is arranged for each horizontal line and a phase-shifted ramp voltage is applied from each waveform generator to each horizontal line. Nevertheless, the provision of the low-pass filter 84 for each horizontal line complicates the circuit configuration of this organic EL display apparatus.

SUMMARY OF THE INVENTION

Accordingly, it is an object of the present invention to provide a ramp voltage generating apparatus and an active matrix drive-type display apparatus having a simple circuit configuration capable of generating a plurality of ramp voltages out of phase with each other.

According to the present invention, a ramp voltage generating apparatus includes a voltage output circuit for outputting a ramp voltage, a ramp voltage generating circuit for generating a plurality of ramp voltages out of phase with each other from the ramp voltage, and a control circuit for controlling an operation of the ramp voltage generating circuit. The ramp voltage generating circuit includes a plurality of voltage generating circuit portions connected in parallel to a voltage input terminal to be supplied with the ramp voltage output from the voltage output circuit. Each of the voltage generating circuit portions includes a voltage output terminal, a capacitor arranged on a line extending from the voltage input terminal to the voltage output terminal, an amplifier arranged on the portion of the line closer to the voltage output terminal than to the capacitor, a first switching element interposed between the capacitor and the amplifier on the line, a second switching element arranged on a feedback line connecting the output terminal of the amplifier and a connecting point of the capacitor and the first switching element, and a third switching element arranged on a power supply line connected to the connecting point. The control circuit turns on the third switching elements of the plurality of voltage generating circuit portions while shifting the time point of switching each of the third switching elements from off to on state. The control circuit turns off the first switching elements and, also, turns on the second switching elements of the plurality of voltage generating circuit portions during the period including the fall time point and the rise time point of the ramp voltage input to the voltage input terminal.

In the ramp voltage generating apparatus according to the present invention, a ramp voltage is supplied from the voltage output circuit to the plurality of voltage generating circuit portions constituting the ramp voltage generating circuit.

In each voltage generating circuit portion, the third switching element is turned on periodically, and during the period including the fall or rise time point of the ramp voltage supplied from the voltage output circuit, the first switching element is turned off and, also, the second switching element is turned on.

In the state where the first switching element is in the on state and the second switching element is in the off state, the third switching element is turned on, so that the power source voltage is applied to the output side of the capacitor and accumulated as electric charges in the capacitor. Herein, the output voltage of the amplifier takes the same voltage level as the power source voltage. After that, the third switching element is turned off, so that the output voltage of the amplifier changes from the power source voltage value following the ramp voltage applied to the input side of the capacitor. During the period including the fall or rise time point of the ramp voltage, therefore, the first switching element is turned off and, also, the second switching element is turned on, so that regardless of the change in the ramp voltage output from the voltage output circuit, the output voltage of the amplifier is kept at a value as of the time point of the switching of the two switching elements. Upon lapse of this period, the first switching element is turned on and, also, the second switching element is turned off. Thus, the output voltage of the amplifier changes with the ramp voltage from the voltage value described above. After that, the third switching element is turned on again and returns to the same voltage level as the power source voltage.

In each voltage generating circuit portion, as described above, by controlling the on/off operation of the first to third switching elements, a new ramp voltage is output from the amplifier, which repeats the process of increasing from the power source voltage value following the ramp voltage output from the voltage output circuit and returning to the power source voltage value at the time point when the third switching element is turned on. The time points at which the third switching elements of the plurality of voltage generating circuit portions turn from off to on state are shifted from each other, and therefore the ramp voltages output from the voltage generating circuit portions are out of phase with each other.

As described above, the phases of the plurality of ramp voltages can be shifted from each other by shifting the time point of switching the third switching element from off to on state. Therefore, neither a D/A converter nor a delay circuit is required. Also, since the new ramp voltage is generated from the ramp voltage output from the voltage output circuit, the low-pass filter is also unnecessary, thereby simplifying the circuit configuration. Further, since each voltage generating circuit portion includes no low-pass filter, the circuits in subsequent stages are not affected.

Specifically, when the third switching element of each voltage generating circuit portion is in an on state, the control circuit can supply a first power source voltage or a second power source voltage to each connecting point through the power supply line connected to the third switching element. Further, the control circuit may output the first power source voltage during part of the on-period of each third switching element and, also, output the second power source voltage during the period containing the time point of turning each third switching element from on to off state.

When the third switching element is turned on in the case where the first switching element is in the on state and the second switching element is in the off state, the control circuit outputs the first power source voltage during part of the period at which the third switching element is on. Then, the first power source voltage is applied to the output side of the capacitor of the voltage generating circuit portion and accumulated as electric charges. Herein, the output voltage of the amplifier takes the same voltage level as the first power source voltage. At the time point when the third switching element is turned from on to off state, the control circuit outputs the second power source voltage and therefore the output voltage of the amplifier takes the same voltage level as the second power source voltage.

The pixels on an external display panel are driven by use of the output voltage of the amplifier which changes in steps, i.e., the ramp voltage generated by the ramp voltage generating circuit, and the difference voltage between the first power source voltage and the second power source voltage is set appropriately. Then, the restraints on the output voltage (data voltage) of the data driver for applying the display data to the pixels are eliminated, thereby permitting more flexibility in design of the active matrix drive-type display apparatus having the ramp voltage generating apparatus.

Specifically, the control circuit turns on/off the second switching element and the third switching element in such a manner that the on-period of the second switching element and the on-period of the third switching element do not overlap.

In the case where the on-period of the second switching element and the on-period of the third switching element overlap, the power source voltage is applied to the output terminal of the amplifier probably resulting in the damage to the amplifier. In the specific configuration described above, therefore, the second switching element and the third switching element are controlled by being turned on and off in such a manner that the on-periods of the two switching elements do not overlap.

According to the present invention, a first active matrix drive-type display apparatus has a display panel including a plurality of pixels arranged in a matrix, and each pixel of the display panel includes a display element for emitting light when supplied with power and a drive circuit for comparing a data voltage supplied from outside the pixel with a ramp voltage and supplying power to the display element in accordance with the result of comparison. The display apparatus includes a voltage output circuit for outputting the ramp voltage, a ramp voltage generating circuit for generating ramp voltages for a plurality of horizontal lines constituting one screen based on the ramp voltage output from the voltage output circuit, and a control circuit for controlling an operation of the ramp voltage generating circuit. The ramp voltage generating circuit includes a plurality of voltage generating circuit portions connected in parallel to a voltage input terminal to be supplied with the ramp voltage output from the voltage output circuit. Each of the voltage generating circuit portions includes a voltage output terminal connected to pixels on one or more horizontal lines, a capacitor arranged on a line extending from the voltage input terminal to the voltage output terminal, an amplifier arranged on the portion of the line closer to the voltage output terminal than to the capacitor, a first switching element interposed between the capacitor and the amplifier on the line, a second switching element arranged on a feedback line connecting a output terminal of the amplifier and a connecting point of the capacitor and the first switching element, and a third switching element arranged on a power supply line connected to the connecting point. The control circuit turns on the third switching elements of the plurality of voltage generating circuit portions while shifting the time point of switching each of the third switching elements from off to on state. The control circuit turns off the first switching elements and, also, turns on the second switching elements of the plurality of voltage generating circuit portions during the period including the fall time point and the rise time point of the ramp voltage input to the voltage input terminal.

The first active matrix drive-type display apparatus according to the present invention has the voltage generating circuit, the ramp voltage generating circuit and the control circuit, and these three circuits are part of the ramp voltage generating apparatus according to the present invention, wherein the ramp voltage generating circuit generates a plurality of ramp voltages out of phase with each other, and each ramp voltage is supplied to the pixels on one or more horizontal lines. In each pixel, the drive circuit compares the ramp voltage with the data voltage supplied from outside the pixel, and in accordance with the result of comparison, power is supplied to the display element. The ramp voltages supplied for one or more horizontal lines are out of phase with each other, and therefore, the luminescence time of the display element is distributed, thereby reducing the influence of the voltage drop of the power line in the display panel.

In the first active matrix drive-type display apparatus according to the present invention, the phases of a plurality of ramp voltages can be shifted by shifting the time point of turning the third switching element of the ramp voltage generating circuit from off to on state. Therefore, a D/A converter or a delay circuit is not required for each one or more horizontal lines. Also, since a new ramp voltage is generated from the ramp voltage output from the voltage output circuit, the low-pass filter is not required for each one or more horizontal lines, thereby simplifying the circuit configuration. Each voltage generating circuit portion of the ramp voltage generating circuit has no low-pass filter and therefore the circuits constituting the pixels in subsequent stages are not affected.

In a first specific configuration, the control circuit includes a scanning driver and a data driver connected to the display panel, and each pixel of the display panel includes a write element turned on by the scanning voltage applied thereto from the scanning driver, and a voltage holding unit for holding the data voltage applied thereto from the data driver when the write element is an on state. The drive circuit is for comparing the output voltage of the voltage holding unit with the ramp voltage generated by the ramp voltage generating circuit. The third switching element of each voltage generating circuit portion is turned on/off in accordance with the scanning voltage output from the scanning driver.

In the first specific configuration described above, the scanning voltage is applied from the scanning driver to the write element constituting each pixel thereby to turn on the write element. In this way, the data voltage is applied from the data driver to and held in the voltage holding unit.

The third switching elements of the plurality of voltage generating circuit portions are supplied with the scanning voltage from the scanning driver, and each third switching element is turned on/off by the scanning voltage. Therefore, the on-period of each third switching element is shifted by one horizontal scanning period (i.e. the scanning period for scanning one horizontal scanning line) on or one vertical scanning period (i.e. the scanning period for scanning one vertical scanning line). As a result, the phase of the ramp voltage output from each voltage generating circuit portion is shifted by one horizontal scanning period or one vertical scanning period.

The drive circuit of each pixel compares the output voltage (data voltage) of the voltage holding unit with the ramp voltage generated by the ramp voltage generating circuit, and in accordance with the result of comparison, power is supplied to the display element.

In a second specific configuration, the control circuit includes a scanning driver and a data driver connected to the display panel, and each pixel of the display panel includes a write element turned on by the scanning voltage applied thereto from the scanning driver, and a voltage holding unit for holding the data voltage applied thereto from the data driver when the write element is in an on state. The drive circuit is for comparing the output voltage of the voltage holding unit with the ramp voltage generated by the ramp voltage generating circuit. The third switching element of each voltage generating circuit portion is turned on/off in accordance with an on/off control signal, and the ramp voltage generating circuit generates the on/off control signal for the third switching element of each voltage generating circuit portion based on the scanning voltage from the scanning driver.

In the second specific configuration described above, the write element constituting each pixel is fed with the scanning voltage from the scanning driver thereby to turn on the write element. In this way, the data voltage is applied from the data driver to and held in the voltage holding unit.

In the ramp voltage generating circuit, the on/off control signal for the third switching element of each voltage generating circuit portion is generated based on the scanning voltage from the scanning driver, and the on/off operation of each third switching element is controlled by the on/off control signal. For example, the third switching elements are turned on/off by shifting the on-period by the time required for scanning a plurality of horizontal lines. As a result, the phases of the ramp voltages output from the voltage generating circuit portions are shifted by the time required for scanning the plurality of horizontal lines. By doing so, the total number of the voltage generating circuit portions is reduced for a smaller circuit size.

The drive circuit of each pixel compares the output voltage (data voltage) of the voltage holding unit with the ramp voltage generated by the ramp voltage generating circuit, and in accordance with the result of comparison, power is supplied to the display element.

Specifically, the voltage output circuit outputs the ramp voltage which falls or rises during a blanking period with a cycle equivalent to an integer multiple of one horizontal scanning period or one vertical scanning period.

In the case where the on-period of the second switching element and the on-period of the third switching element are superposed on each other, the power source voltage is applied to the output terminal of the amplifier, thereby often resulting in the damage to the amplifier. The second switching element is turned on during the period containing the fall or rise time point of the ramp voltage as described above, while the third switching element is turned off during the blanking period in one horizontal scanning period or one vertical scanning period. The voltage output circuit, therefore, outputs the ramp voltage which falls or rises during the blanking period with a cycle equivalent to an integer multiple of one horizontal scanning period or one vertical scanning period.

According to the present invention, a second active matrix drive-type display apparatus has a display panel including a plurality of pixels arranged in a matrix, and each pixel of the display panel includes a display element for emitting light when supplied with power and a drive circuit for supplying power to the display element in accordance with a data voltage supplied from outside the pixel. The display apparatus has a voltage output circuit for outputting a ramp voltage, a ramp voltage generating circuit for generating ramp voltages for a plurality of horizontal lines constituting one screen based on the ramp voltage, and a control circuit for controlling an operation of the ramp voltage generating circuit. The ramp voltage generating circuit includes a plurality of voltage generating circuit portions connected in parallel to a voltage input terminal to be supplied with the ramp voltage output from the voltage output circuit. Each of the voltage generating circuit portions includes a voltage output terminal connected to pixels on one or more horizontal lines, a capacitor arranged on a line extending from the voltage input terminal to the voltage output terminal, an amplifier arranged on the portion of the line closer to the voltage output terminal than to the capacitor, a first switching element interposed between the capacitor and the amplifier on the line, a second switching element arranged on a feedback line connecting a output terminal of the amplifier and a connecting point of the capacitor and the first switching element, and a third switching element arranged on a power supply line connected to the connecting point. The control circuit turns on the third switching elements of the plurality of voltage generating circuit portions while shifting the time point of switching each of the third switching elements from off to on state. The control circuit turns off the first switching elements and, also, turns on the second switching elements of the plurality of voltage generating circuit portions during the period including the fall time point and the rise time point of the ramp voltage input to the voltage input terminal.

The second active matrix drive-type display apparatus according to the present invention has the voltage generating circuit, the ramp voltage generating circuit and the control circuit, and these three circuits are part of the ramp voltage generating apparatus according to the present invention. The ramp voltage generating circuit generates a plurality of ramp voltages out of phase with each other, and each ramp voltage is supplied to the pixels on one or more horizontal lines. In each pixel, the power corresponding to the data voltage supplied from outside the pixel is supplied to the display element by the drive circuit. The ramp voltages supplied for each one or more horizontal lines are out of phase with each other, and therefore the time point when the display element emits light is dispersed, thereby reducing the influence of the voltage drop on the power line in the display panel.

In the second active matrix drive-type display apparatus according to the present invention, the phases of a plurality of ramp voltages can be shifted by shifting the time point of turning the third switching element of the ramp voltage generating circuit from off to on state. Therefore, a D/A converter or a delay circuit is not required for each one or more horizontal lines. Also, since a new ramp voltage is generated from the ramp voltage output from the voltage output circuit, the low-pass filter is not required for each one or more horizontal lines, thereby simplifying the circuit configuration. Each voltage generating circuit portion of the ramp voltage generating circuit has no low-pass filter and therefore the circuits constituting the pixels in subsequent stages are not affected.

In the second active matrix drive-type display apparatus, for example, the control circuit includes a scanning driver and a data driver connected to the display panel. Each pixel of the display panel includes a write element turned on upon application thereto of a scanning voltage from the scanning driver, and a voltage holding unit for holding the data voltage applied thereto from the data driver when the write element is in an on state. The drive circuit supplies power to the display element in accordance with the data voltage held by the voltage holding unit and the ramp voltage generated, when the write element is in an off state, by the ramp voltage generating circuit. The control circuit can output and supply a first power source voltage or a second power source voltage to each connecting point through the power supply line connected to each third switching element of each voltage generating circuit portion when the third switching element is turned on; turns on the third switching element of the voltage generating circuit portion having the voltage output terminal connected to the pixel having the write element in the on state and, also, outputs the first power source voltage when the write element of the pixel is in the on state; and after the write element is turned from on to off state, keeps the third switching element on for a predetermined period of time and switches the output voltage from the first power source voltage to the second power source voltage during the predetermined period of time.

In this configuration, when the write element of the pixel on the first horizontal line is turned on in the case where the first switching element is in the on state and the second switching element is in the off state, the third switching element of the voltage generating circuit portion for supplying a ramp voltage to the pixel on the first horizontal line is turned on. Therefore, the first power source voltage is applied to the output side of the capacitor of the voltage generating circuit portion and accumulated as electric charges. Herein, the output voltage of the amplifier takes the same voltage level as the first power source voltage, and therefore the first power source voltage is applied to the pixel arranged on the first horizontal line as a ramp voltage generated by the ramp voltage generating circuit.

After subsequent turning off of the write element of each pixel that has thus far been in the on state, the third switching element is kept on for a predetermined period of time, and the output voltage of the control circuit is switched from the first power source voltage to the second power source voltage during the same period. As a result, the output voltage of the amplifier takes the same voltage level as the second power source voltage. This second power source voltage is applied to the pixel on the first horizontal line with the write element thereof turned off, as a ramp voltage generated by the ramp voltage generating circuit.

The drive circuit is activated in response to the data voltage applied thereto and held with the write element on and the ramp voltage with the write element in the off state. Therefore, the drive circuit is activated also in response to the difference between the first power source voltage and the second power source voltage output from the control circuit. As long as the difference voltage is set appropriately, therefore, the restraints on the setting of the data voltage (upper and lower limits) output from the data driver are eliminated, thereby permitting more flexibility in design of the active matrix drive-type display apparatus.

Also, the difference voltage between the first power source voltage and the second power source voltage may be adjustable.

As a result, flexibility in design can be further increased and, also, the display quality of the display panel can be improved.

DETAILED DESCRIPTION OF PREFERRED EMBODIMENTS

First Embodiment

An organic EL display apparatus according to a first embodiment of the present invention will be described specifically with reference to the drawings.

Figure 1:
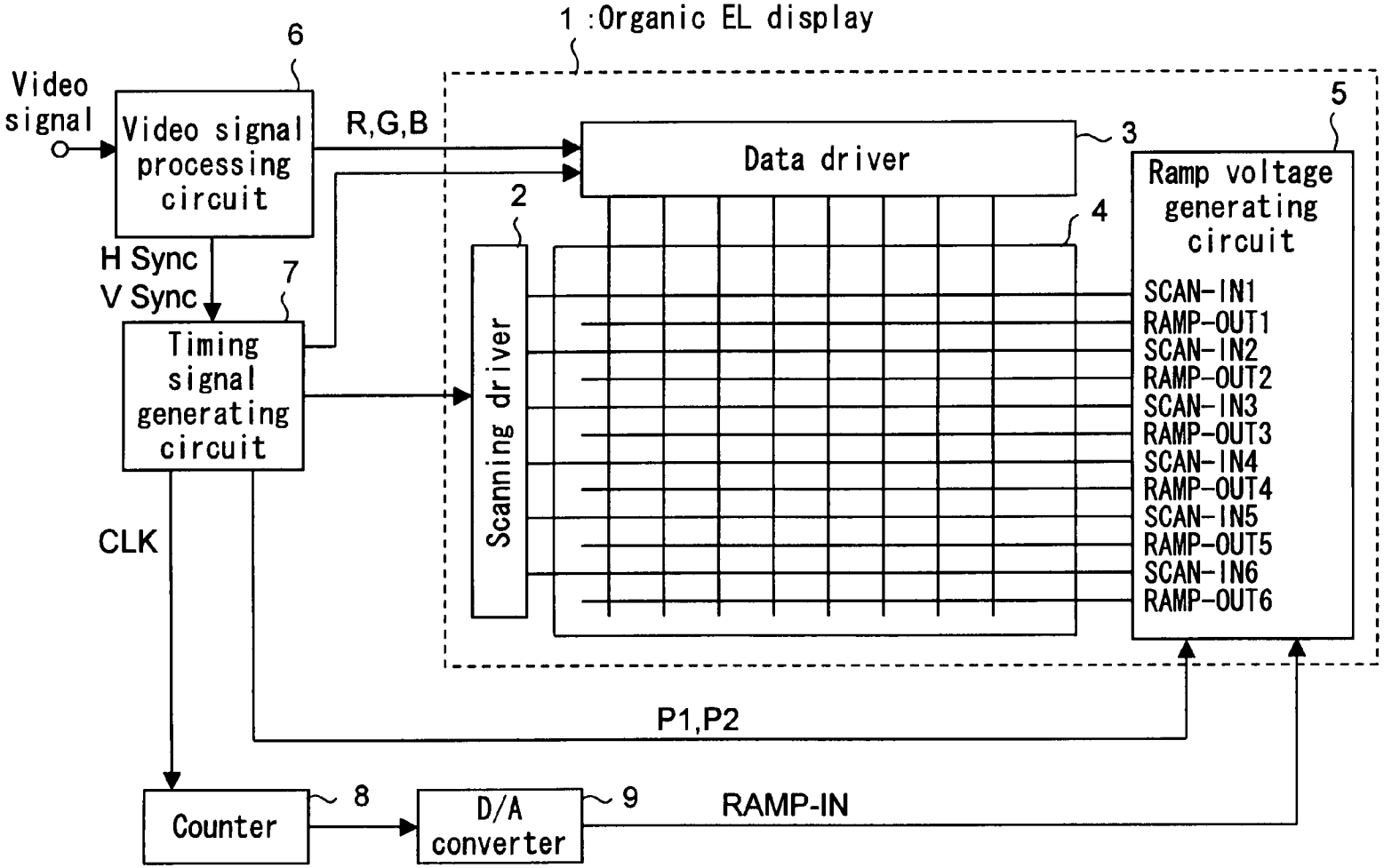
FIG. 1 is a block diagram showing a configuration of an organic EL display apparatus according to a first embodiment of the present invention.

(FIG. 1: Block Diagram of General Configuration)

FIG. 1 is a block diagram showing a general configuration of the organic EL display apparatus according to the first embodiment of the present invention. An organic EL display 1, as shown in FIG. 1, includes a display panel 4 with a plurality of pixels arranged in matrix, to which a scanning driver 2, a data driver 3 and a ramp voltage generating circuit 5 are connected.

A video signal supplied from a video source such as a TV receiver (not shown) is supplied to a video signal processing circuit 6 and is processed as required for video display. The resulting video signals of RGB primary colors are supplied to the data driver 3 of the organic EL display 1.

A horizontal sync (synchronizing) signal Hsync and a vertical sync signal Vsync obtained from the video signal processing circuit 6 are supplied to a timing signal generating circuit 7, and the resultant timing signal is supplied to the scanning driver 2 and the data driver 3.

Figures 3A, 3B, 3C, 3D:
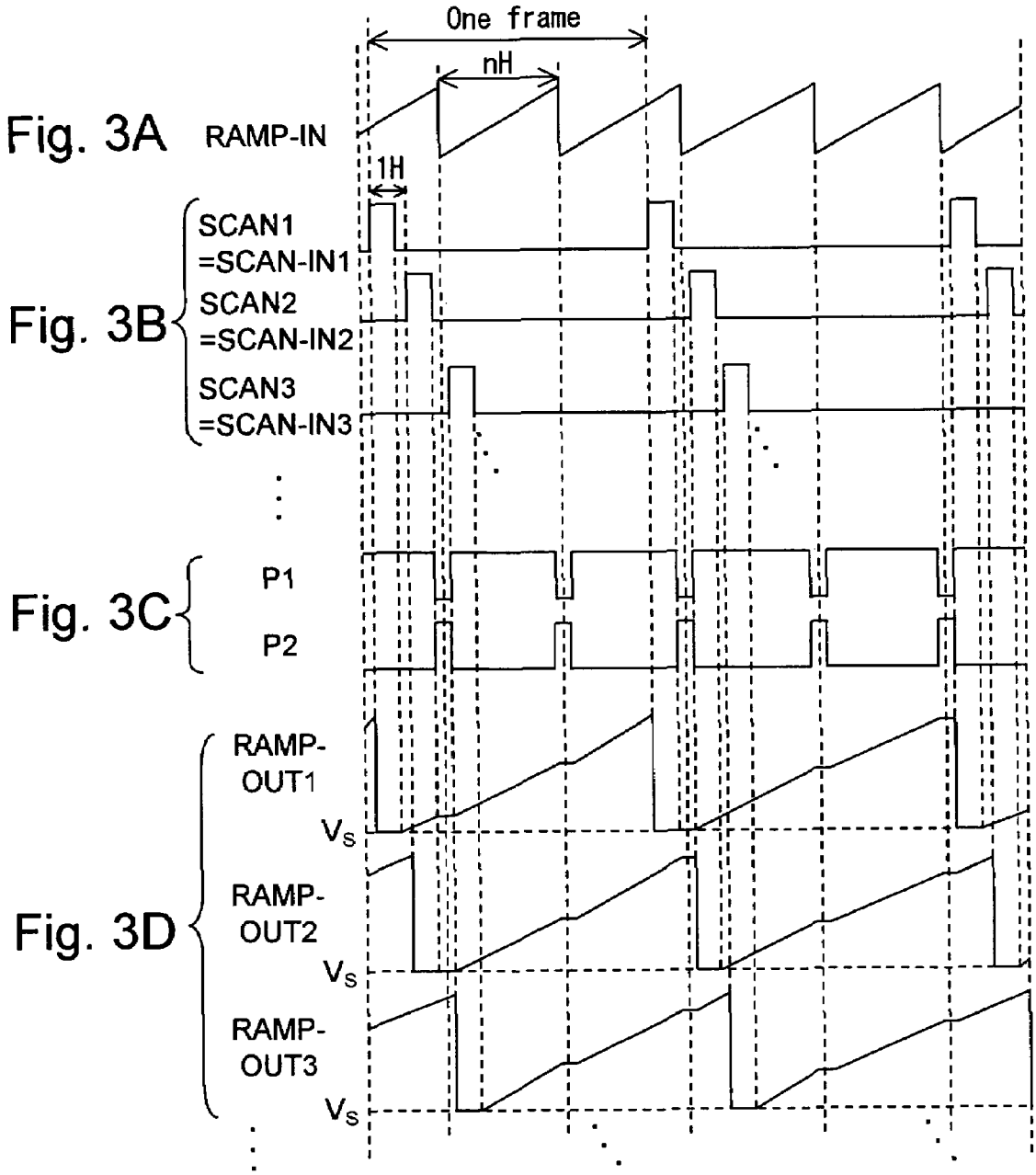
FIGS. 3A to 3D are waveform diagrams showing an operation of the ramp voltage generating circuit shown in FIG. 2.

A clock pulse CLK obtained from the timing signal generating circuit 7 is supplied to a counter 8. In the counter 8, the counter variable is counted up to a predetermined value based on the clock pulse, and reset to the initial value. This operation is repeated. The count obtained from the counter 8 is supplied to an D/A converter 9 and based on the count, a ramp voltage RAMP-IN changing like a sawtoothed wave, as shown in FIG. 3A, is generated and supplied to the ramp voltage generating circuit 5 of the organic EL display 1. The voltage output circuit having the function of outputting the ramp voltage RAMP-IN is mainly composed of the timing signal generating circuit 7, the counter 8 and the D/A converter 9.

Further, a first switching pulse P1 and a second switching pulse P2 obtained from the timing signal generating circuit 7 are applied to the ramp voltage generating circuit 5.

The ramp voltage generating circuit 5 is for generating ramp voltages (RAMP-OUT1, RAMP-OUT2, RAMP-OUT3 and so forth in FIGS. 2 and 3D) for a plurality of horizontal lines constituting a screen. The ramp voltage generating circuit 5 is supplied with scanning voltages (SCAN1, SCAN2, SCAN3 and so forth) from the scanning driver 2, and as described later, performs the switching operation based on the scanning voltage and the switching pulses P1, P2. As a result, a plurality of ramp voltages out of phase with each other shown in FIG. 3D are generated from the ramp voltage RAMP-IN shown in FIG. 3A, and each ramp voltage is supplied to each pixel on each horizontal line.

Incidentally, each circuit, each driver and the organic EL display shown in FIG. 1 are connected to a power circuit (not shown).

Figure 4:
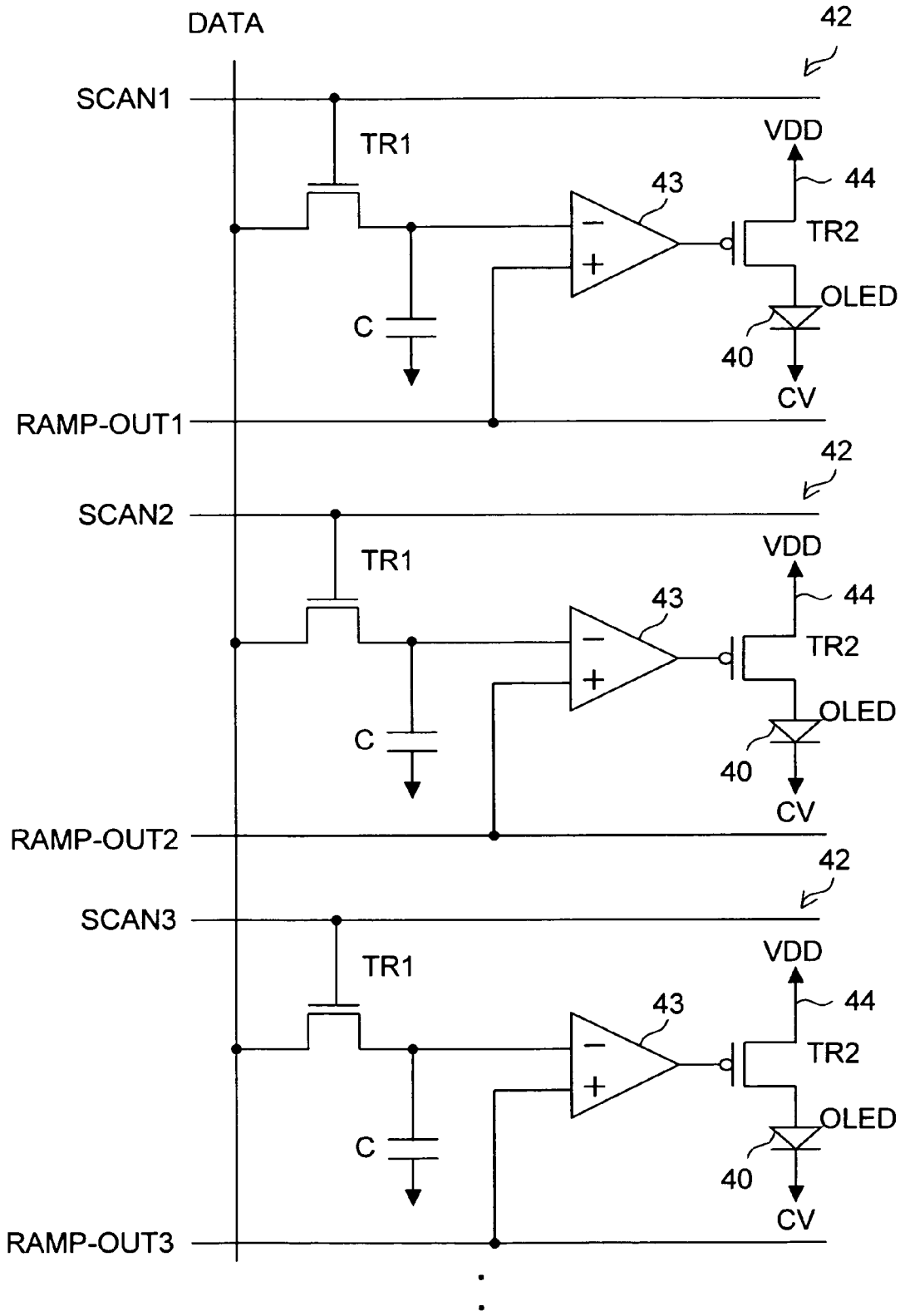
FIG. 4 is a circuit diagram showing a configuration of pixels on a display panel shown in FIG. 1.

(FIG. 4: Description of Pixels)

Figure 15:
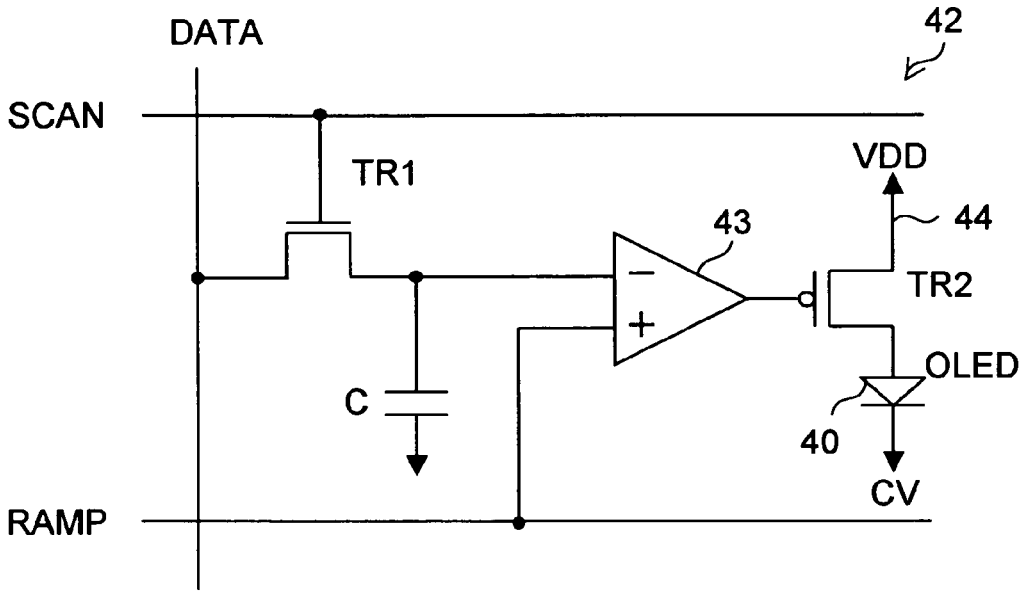
Fig. 15 PRIOR ART
FIG. 15 is a diagram showing a circuit configuration of pixels of the organic EL display apparatus shown in FIG. 14.
Figures 16A, 16B, 16C:
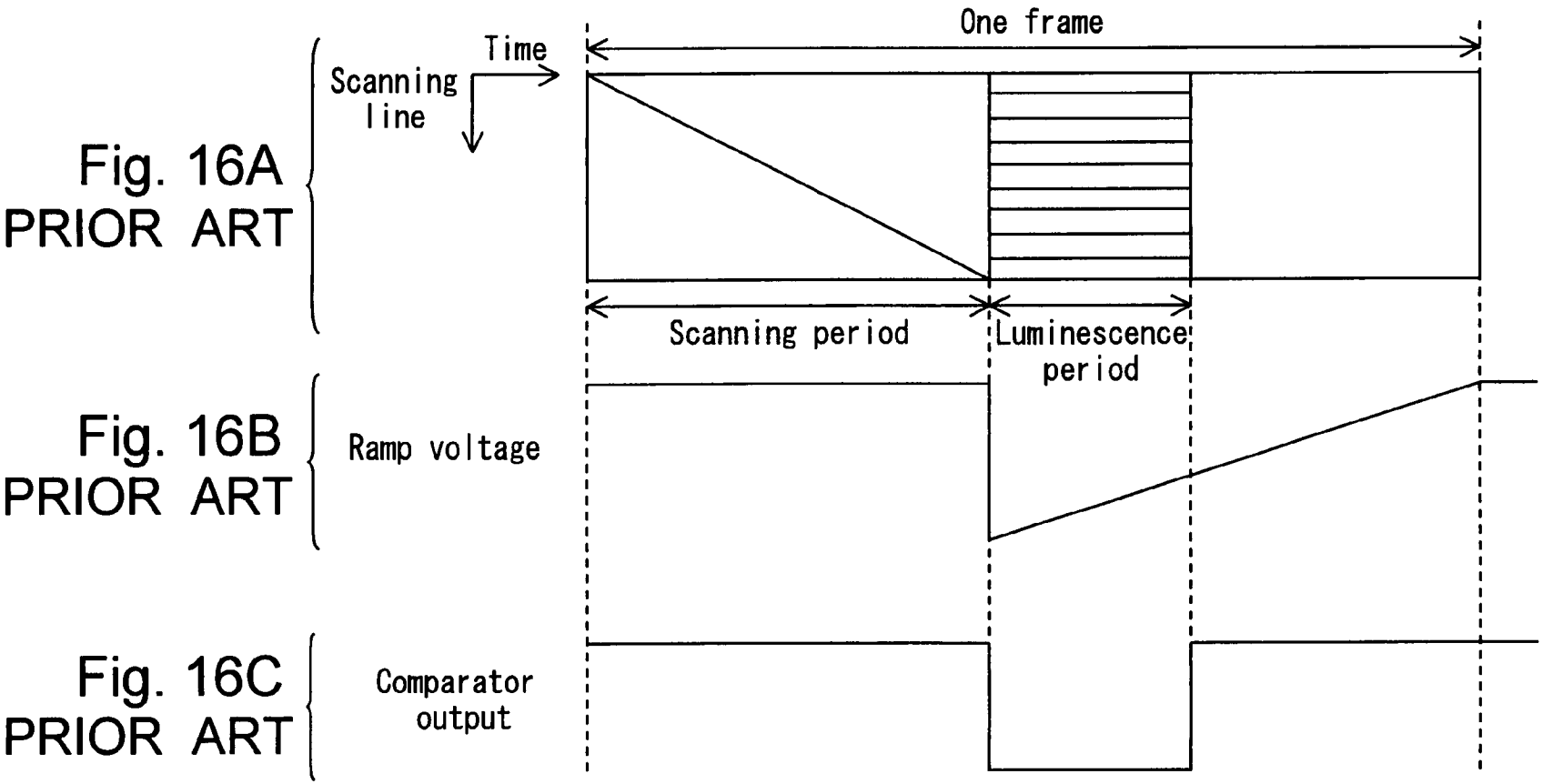
Fig. 16A PRIOR ART
Fig. 16B PRIOR ART
Fig. 16C PRIOR ART
FIGS. 16A to 16C are waveform diagrams showing an operation of the organic EL display apparatus shown in FIG. 14.
Figure 17:
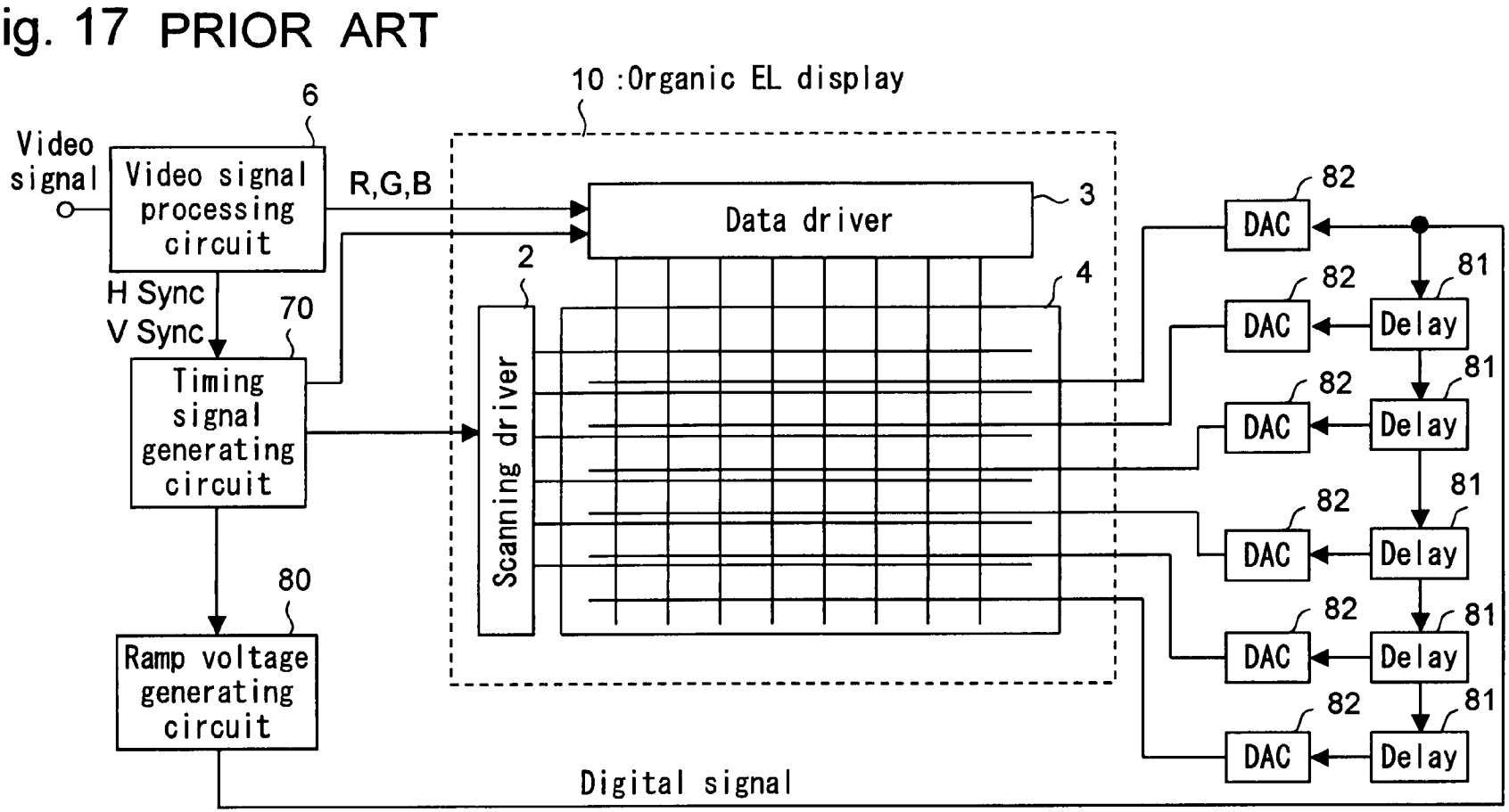
Fig. 17 PRIOR ART
FIG. 17 is a block diagram showing a configuration of another conventional organic EL display apparatus proposed by the present applicant.
Figure 18:
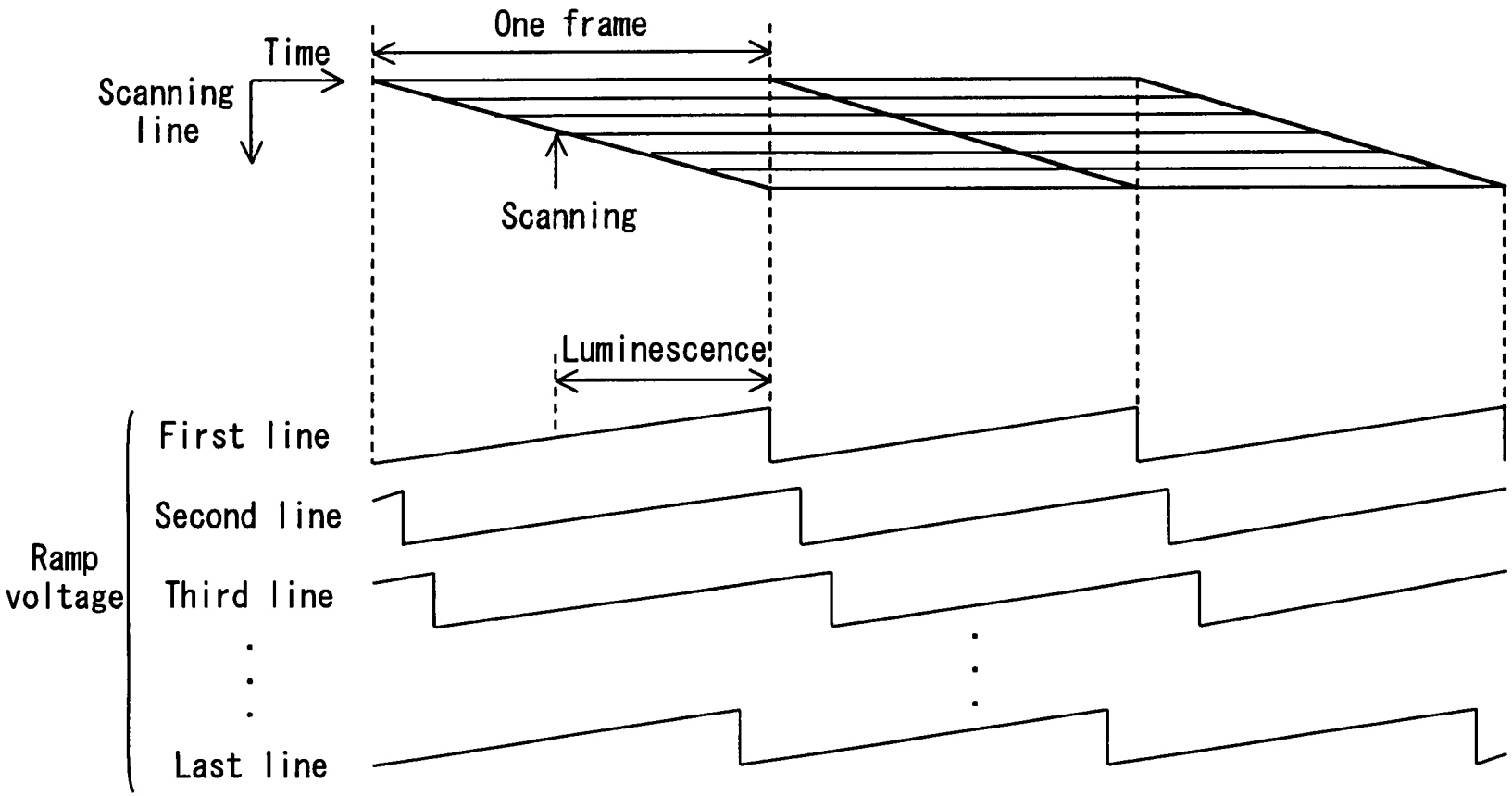
Fig. 18 PRIOR ART
FIG. 18 is a waveform diagram showing an operation of the organic EL display apparatus shown in FIG. 17.
Figure 19:
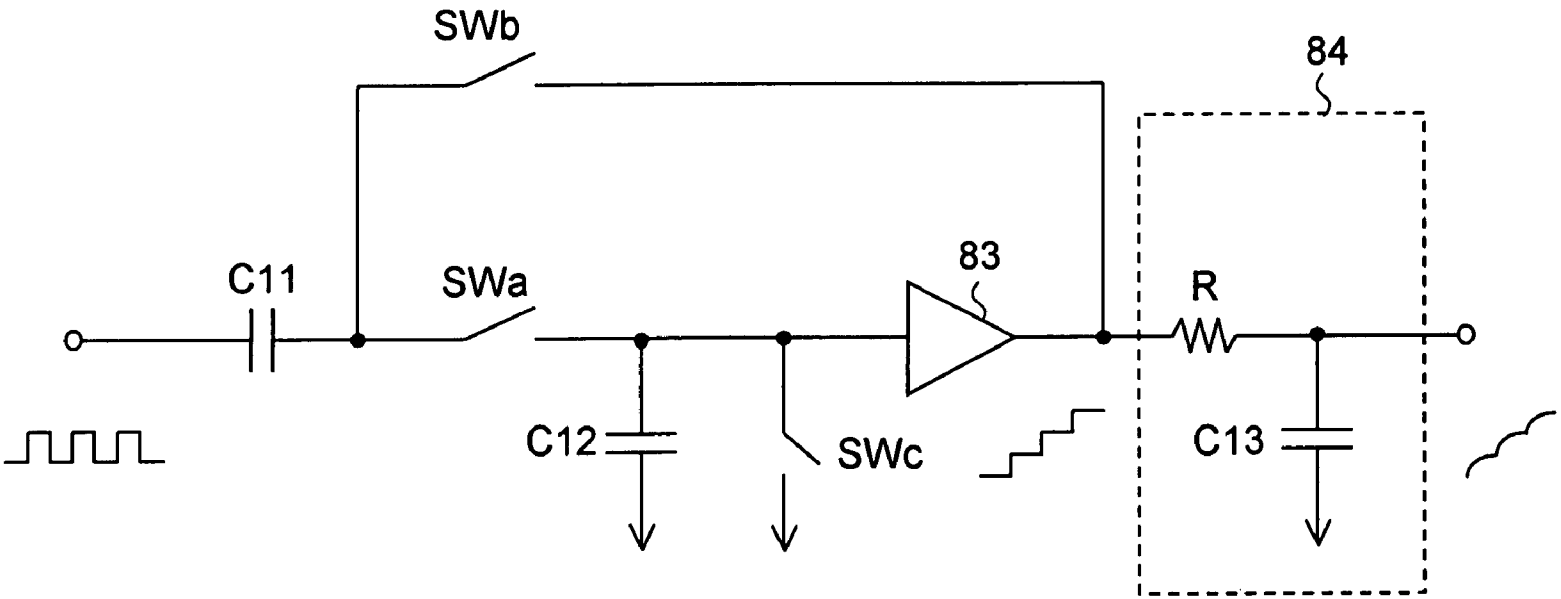
Fig. 19 PRIOR ART
FIG. 19 is a diagram showing a circuit configuration of a waveform generator of the conventional organic EL display apparatus.

The display panel 4 is composed of a plurality of pixels having the circuit configuration shown in FIG. 15 arranged in matrix. FIG. 4 shows pixels 42 on the first to third horizontal lines (corresponding to SCAN1 to SCAN3).

Each pixel 42 includes an organic EL element 40 as a display element for emitting light upon receipt of power, a drive transistor TR2 for turning on/off the power supplied to the organic EL element 40 in accordance with the input of an on/off control signal to the gate thereof, a write transistor TR1 constituting a write element turned on upon application of the scanning voltage (one of SCAN1, SCAN2, SCAN3 and so forth) to the gate thereof from the scanning driver 2, a capacitor C fed with the data voltage (DATA) from the data driver 3 when the write transistor TR1 is in an on state, and a comparator 43 for comparing the ramp voltage (one of RAMP-OUT1, RAMP-OUT2, RAMP-OUT3 and so forth) supplied from the ramp voltage generating circuit 5 and the output voltage of the capacitor C with each other, both being applied to a pair of positive and negative input terminals, respectively, of the comparator 43. The output signal of each comparator 43 is supplied to the gate of the corresponding drive transistor TR2.

The source of each drive transistor TR2 is connected to a current supply line 44, and the drain of each drive transistor TR2 is connected to an organic EL element 40. One of the electrodes (e.g., source) of each write transistor TR1 is connected to the data driver 3, and the other electrode (e.g., drain) of each write transistor TR1 is connected to one end of the corresponding capacitor C and to the inverted input terminal of each comparator 43. The non-inverted input terminal of the comparator 43 is connected to the output terminal of the ramp voltage generating circuit 5.

In the organic EL display apparatus described above, the write transistor TR1 constituting each pixel 42 for each horizontal line is fed with the scanning voltage SCAN1 or the like from the scanning driver 2, and the corresponding write transistor TR1 is turned on. As a result, the data voltage from the data driver 3 is applied to and accumulated as charge in the capacitor C. The capacitor C has the function as a voltage holding unit to hold these data voltage.

In each pixel 42, as described above, the ramp voltage RAMP-OUT1 or the like obtained from the ramp voltage generating circuit 5 is applied to the non-inverted input terminal of the comparator 43, while the output voltage (data voltage) of the capacitor C is applied to the inverted input terminal of the comparator 43 at the same time. As a result, the output of the comparator 43 takes two values, H (high) and L (low) in accordance with the result of comparison between the two voltages. The length of time during which the output of the comparator 43 is at L level is proportional to the magnitude of the data voltage. In this way, the output of the comparator 43 remains at L level only during the period when it is proportional to the magnitude of the data voltage. Thus, the transistor TR2 is turned on and the organic EL element 40 is energized only during the same period. As a result, the organic EL element 40 of each pixel 42 emits light only during the period proportional to the magnitude of the data voltage for each pixel 42. The comparator 43 and the drive transistor TR2 function as a drive circuit for comparing the data voltage with the ramp voltage (RAMP-OUT1 or the like) and supplying power to the organic EL element 40 in accordance with the result of comparison.

Figure 2:
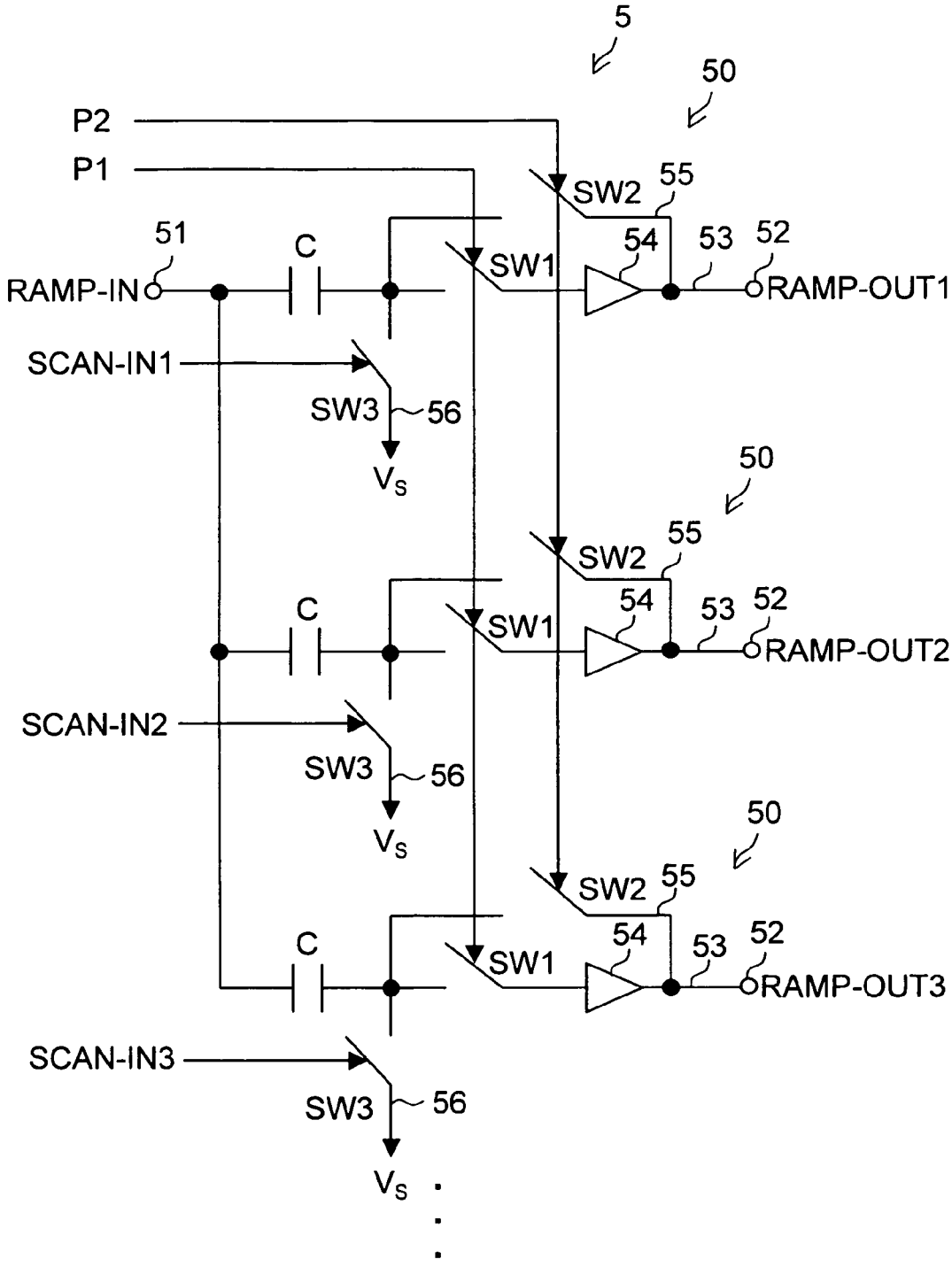
FIG. 2 is a circuit diagram showing a configuration of a ramp voltage generating circuit shown in FIG. 1.

(FIGS. 2 and 3: Description of Operation)

FIG. 2 shows the ramp voltage generating circuit 5. The ramp voltage generating circuit 5 includes one voltage input terminal 51 and voltage generating circuit portions 50, connected in parallel to the voltage input terminal 51, as many as the horizontal lines constituting one screen. The voltage input terminal 51 is connected to the output terminal of the D/A converter 9. Each voltage generating circuit portion 50 includes one voltage output terminal 52. Each voltage output terminal 52 is connected to the pixels 42 arranged on each horizontal line of the display panel 4. By way of these output terminals 52, the ramp voltages RAMP-OUT1, RAMP-OUT2, RAMP-OUT3 and so forth are output from the ramp voltage generating circuit 5.

A line 53 extends from the voltage input terminal 51 toward the voltage output terminal 52 of each voltage generating circuit portion 50. This line 53 has arranged thereon the capacitor C and an operational amplifier 54 constituting an amplifier having the gain of unity. The line 53 has also arranged thereon a first switching element SW1 between the capacitor C and the operational amplifier 54.

The output terminal of the operational amplifier 54 and the connecting point of the capacitor C and the first switching element SW1 are connected to each other by a feedback line 55, which in turn has arranged thereon a second switching element SW2. Also, the connecting point of the capacitor C and the first switching element SW1 is connected with a power supply line 56, which in turn has arranged thereon a third switching element SW3. An end of the power supply line 56 is fed with a power source voltage Vs.

According to this embodiment, the scanning voltages SCAN1, SCAN2, SCAN3 and so forth supplied to the ramp voltage generating circuit 5 from the scanning driver 2 are coincident with the on/off control signals SCAN-IN1, SCAN-IN2, SCAN-IN3 and so forth, respectively, for switching the on/off state of each third switching element SW3. The scanning voltages SCAN1, SCAN2, SCAN3 and so forth each with the H-level period shifted by one horizontal scanning period (i.e. the scanning period for scanning one horizontal scanning line) 1H, as shown in FIG. 3B, are supplied from the scanning driver 2 to the plurality of third switching elements SW3 of the ramp voltage generating circuit 5. Thus, each third switching element SW3 is turned on during the period when the corresponding scanning voltage is at H level. As a result, the on period of each third switching element SW3 is shifted by one horizontal scanning period 1H.

The ramp voltage RAMP-IN falling during the blanking period with the period nH equal to an integer multiple of the horizontal scanning period 1H is supplied from the D/A converter 9 to the ramp voltage generating circuit 5 as shown in FIG. 3A.

The first switching pulse P1 which is at L level during the blanking period when the ramp voltage RAMP-IN falls and at H level during other than the blanking period, as shown in FIG. 3C, is supplied from the timing signal generating circuit 7 to the first switching element SW1. The first switching element SW1 is in an on state during the period when the switching pulse P1 is at H level. The second switching element SW2, on the other hand, is supplied with the second switching pulse P2 which is at H level during the blanking period when the ramp voltage RAMP-IN falls and at L level during other than the blanking period as shown in FIG. 3C. The second switching element SW2 is in an on state during the period when the switching pulse P2 is at H level.

In the first voltage generating circuit portion 50 connected to the first horizontal line, as shown in FIG. 3C, the first switching element SW1 is turned on by the H-level switching pulse P1 and the second switching element SW2 is turned off by the L-level switching pulse P2. As shown in FIG. 3B, the third switching element SW3 is turned on by the H-level scanning voltage SCAN1 (=SCAN−IN1). Thus, the power source voltage Vs is applied to the output side of the capacitor C and the same voltage is accumulated as charge. In the process, the output voltage RAMP-OUT1 of the operational amplifier 54 takes the same level as the power source voltage Vs as shown in FIG. 3D.

After that, as shown in FIG. 3B, the third switching element SW3 is turned off by the L-level scanning voltage SCAN1. The output voltage RAMP-OUT1 of the operational amplifier 54, as shown in FIG. 3D, rises gradually from the power source voltage value Vs following the input ramp voltage RAMP-IN shown in FIG. 3A applied to the input side of the capacitor C.

During the blanking period when the input ramp voltage RAMP-IN falls, as shown in FIG. 3C, the first switching element SW1 is turned off by the L-level switching pulse P1, while the second switching element SW2 is turned on by the H-level switching pulse P2. Thus, the output voltage RAMP-OUT1 of the operational amplifier 54, as shown in FIG. 3D, is maintained at the voltage value as of the time point of the switching of the two switching elements SW1, SW2 regardless of the input ramp voltage RAMP-IN. For convenience sake, the description assumes that the blanking period during which the voltage value of the output voltage RAMP-OUT1 is maintained is shown to represent a comparatively large proportion of time in FIG. 3. Normally, however, the number of the scanning lines is about several hundreds, the number n of the period nH is several tens to several hundreds and the blanking period is less than 10% of the horizontal scanning period 1H. Therefore, the blanking period occupies a very small proportion of the whole period. The voltage RAMP-OUT1 ceasing to rise during the blanking period, therefore, actually has substantially no effect on the display quality of the organic EL display 1. This is also the case with the waveforms shown in FIG. 5 and the waveforms in a second embodiment.

After the lapse of the blanking period, as shown in FIG. 3C, the first switching element SW1 is turned on by the H-level switching pulse P1, while the second switching element SW2 is turned off by the L-level switching pulse P2. Thus, the output voltage RAMP-OUT1 of the operational amplifier 54 gradually rises from the above-mentioned voltage value following the input ramp voltage RAMP-IN shown in FIG. 3A.

During the blanking period when the input ramp voltage RAMP-IN falls again, in the same way as during the aforementioned blanking period, the first switching element SW1 is turned off and the second switching element SW2 is turned on. Thus the output voltage RAMP-OUT1 of the operational amplifier 54 is maintained at the voltage value as of the time point of the switching of the two switching elements SW1, SW2. After the lapse of the blanking period, on the other hand, the first switching element SW1 is turned on while the second switching element SW2 is turned off, so that the output voltage RAMP-OUT1 of the operational amplifier 54 gradually increases from the above-mentioned voltage value following the input ramp voltage RAMP-IN.

After that, as shown in FIG. 3B, the third switching element SW3 is turned on by the H-level scanning voltage SCAN1, so that the output voltage RAMP-OUT1 of the operational amplifier 54 returns to the same level as the power source voltage Vs.

As described above, by controlling the on/off operation of the first to third switching elements SW1 to SW3, as shown in FIG. 3D, the ramp voltage RAMP-OUT1 is output from the operational amplifier 54, which repeats the process of gradually increasing from the power source voltage value Vs following the input ramp voltage RAMP-IN and returning to the power source voltage value Vs at the time point when the third switching element SW3 is turned on.

Also in each voltage generating circuit portion 50 connected to the last line from the second horizontal line (corresponding to the scanning voltage SCAN2), like in the first voltage generating circuit 50 described above, the ramp voltage (one of RAMP-OUT2, RAMP-OUT3 and so forth) is output from the operational amplifier 54, which repeats the process of gradually increasing from the power source voltage value Vs following the input ramp voltage RAMP-IN and returning to the power source voltage level Vs at the time point when the third switching element SW3 is turned on. Since the on-period of the third switching element SW3 is shifted by one horizontal scanning period 1H as described above, the phase of the ramp voltage output from the operational amplifier 54 of each voltage generating circuit portion 50 is shifted by one horizontal scanning period 1H as shown in FIG. 3D.

In the organic EL display apparatus according to this embodiment, as shown in FIG. 3D, a ramp voltage having a gentle slope changing from L to H level over one frame period is supplied to each horizontal line, and therefore substantially the whole of each frame period can be used as the luminescence period.

Also, all the horizontal lines can be scanned using substantially the whole of one frame period, and therefore the scanning rate may be low.

Further, the luminescence time is varied from one pixel to another, the influence of the voltage drop of the power line in the display panel is reduced.

In the organic EL display apparatus according to this embodiment, the counter 8 and the D/A converter 9 are arranged on the system body. The D/A converter and the delay circuit, however, are not required for each horizontal line, nor the low-pass filter is required for each horizontal line. Thus, the circuit configuration of the display apparatus is simplified as a whole. Also, the lack of the low-pass filter in each voltage generating circuit portion 50 of the ramp voltage generating circuit 25 eliminates the influence on the circuits constituting the pixels in subsequent stages.

Figures 5A, 5B, 5C, 5D, 5E:
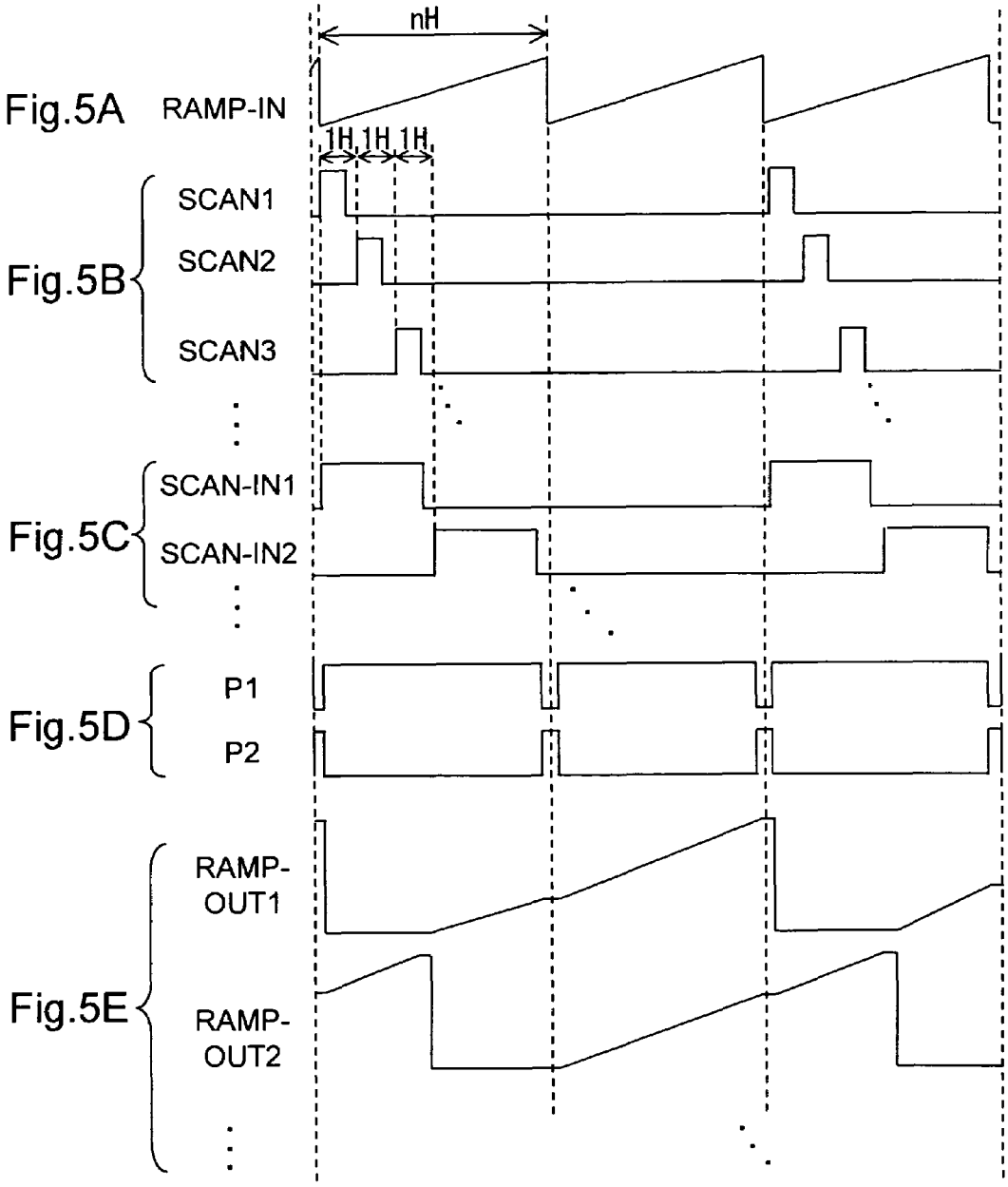
FIGS. 5A to 5E are waveform diagrams showing the operation of the ramp voltage generating circuit in which phases of ramp voltages are shifted for each three horizontal lines.

In the embodiments described above, as shown in FIG. 3D, the phase of the ramp voltage is shifted by one horizontal scanning period 1H for each horizontal line. As an alternative, as shown in FIG. 5E, the phase can be shifted by the time required for scanning three horizontal lines for each three horizontal lines. In the configuration of shifting the phase of the ramp voltage by three horizontal lines, the ramp voltage generating circuit is so configured that a plurality of parallel-connected voltage generating circuits as many as one third of the number of horizontal lines constituting one screen are connected to the voltage input terminal. The ramp voltage generating circuit, based on the scanning voltage (SCAN1, SCAN2, SCAN3 and so forth) shown in FIG. 5B, generates switching pulses with the H-level period shifted by the time required for scanning three horizontal lines, and as shown in FIG. 5C each of the switching pulses is supplied to each third switching elements SW3. Incidentally, the relation between the ramp voltage RAMP-IN shown in FIG. 5A and the first and second switching pulses P1, P2 shown in FIG. 5D is similar to that between the ramp voltage RAMP-IN shown in FIG. 3A and the first and second switching pulses P1, P2 shown in FIG. 3C.

The scanning driver 2 and the timing signal generating circuit 7 according to this embodiment constitute a control circuit for controlling the operation of the ramp voltage generating circuit 5. This control circuit may further include the data driver 3.

Second Embodiment

Next, an organic EL display apparatus according to a second embodiment of the present invention will be described specifically with reference to the drawings.

Figure 6:
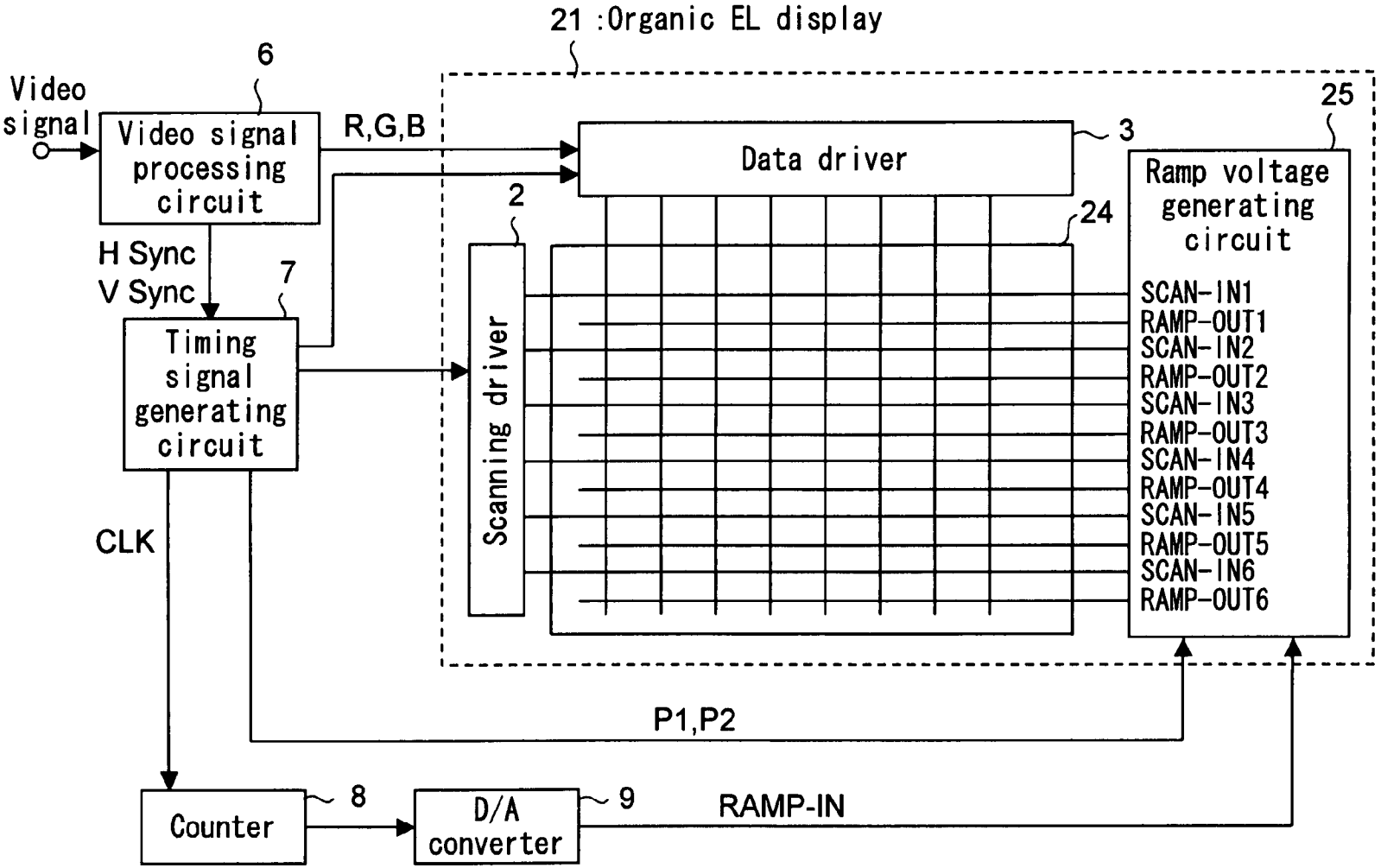
FIG. 6 is a block diagram showing a configuration of an organic EL display apparatus according to a second embodiment of the present invention.

(FIG. 6: Block Diagram of General Configuration)

Figure 7:
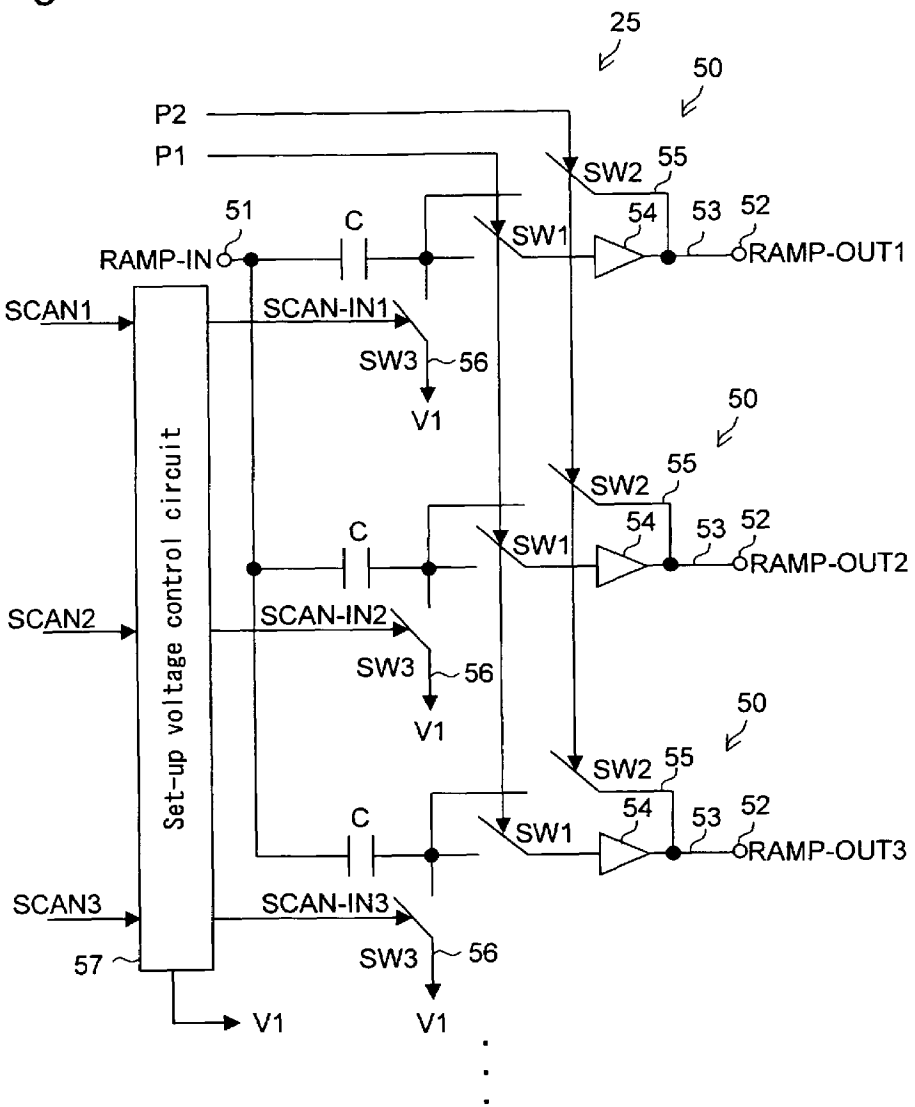
FIG. 7 is a circuit diagram showing a configuration of a set-up voltage control circuit and a ramp voltage generating circuit constituting the organic EL display apparatus shown in FIG. 6.

FIG. 6 is a block diagram showing a general configuration of the organic EL display apparatus according to a second embodiment of the present invention. In FIG. 6, the component parts identical or similar to the corresponding component parts in FIG. 1 are designated by the same reference numerals, respectively, and not described again. An organic EL display 21, as shown in FIG. 6, includes a display panel 24 with a plurality of pixels arranged in matrix thereon, a scanning driver 2, a data driver 3 and a ramp voltage generating circuit 25. Though not shown in FIG. 6, the organic EL display 21 further includes a set-up voltage control circuit 57 (FIG. 7).

Figures 8A, 8B, 8C, 8D, 8E, 8F:
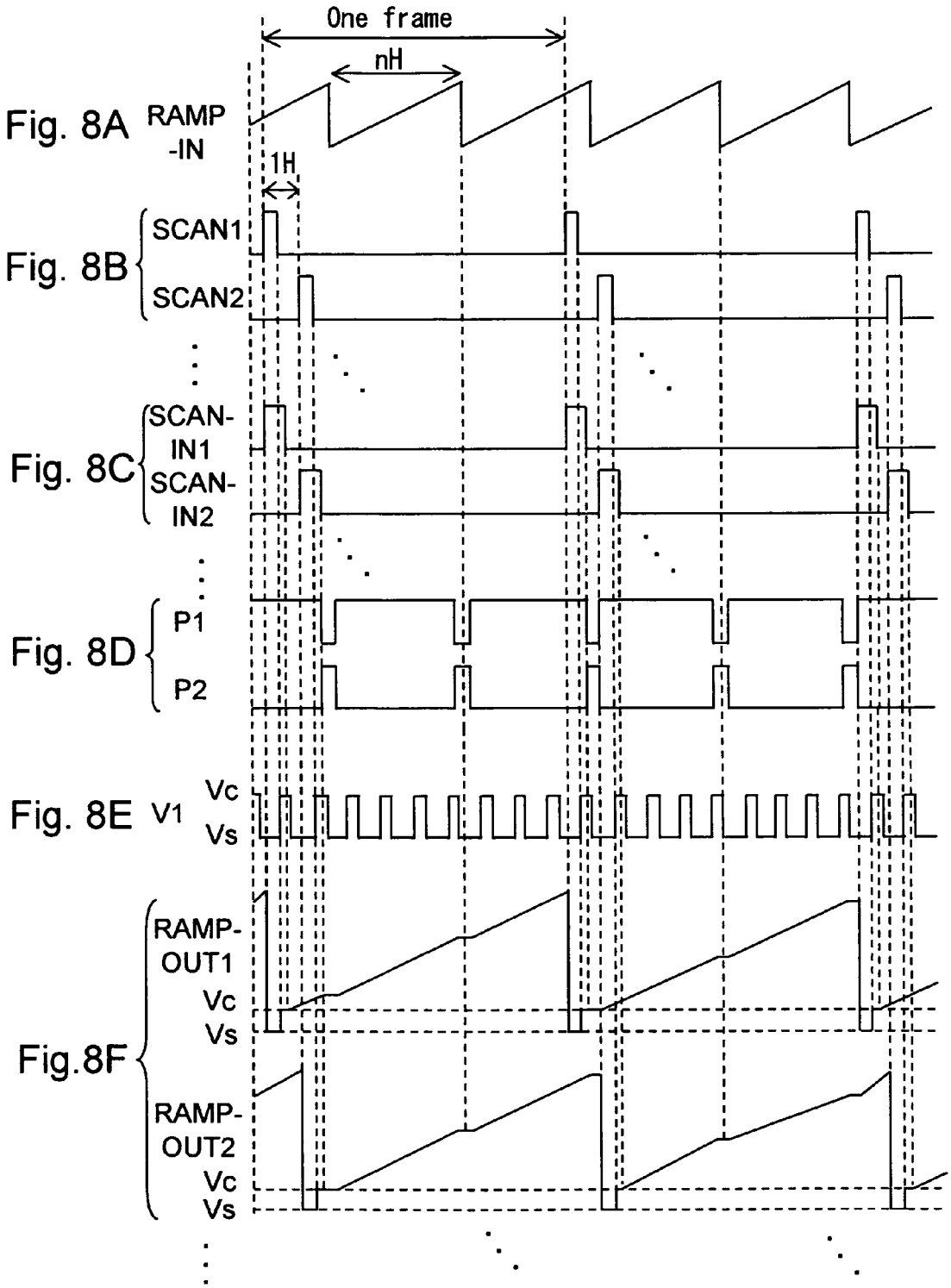
FIGS. 8A to 8F are waveform diagrams showing operations of the set-up voltage control circuit and the ramp voltage generating circuit shown in FIG. 7.

As in the first embodiment, the count obtained from the counter 8 is supplied to the D/A converter 9, and based on the count, a ramp voltage RAMP-IN changing in sawtooth waveform as shown in FIG. 8A is generated and supplied to the ramp voltage generating circuit 25 of the organic EL display 21. The voltage output circuit having the function to output the ramp voltage RAMP-IN is mainly composed of the timing signal generating circuit 7, the counter 8 and the D/A converter 9.

Further, the first switching pulse P1 and the second switching pulse P2 produced from the timing signal generating circuit 7 are applied to the ramp voltage generating circuit 25.

The ramp voltage generating circuit 25 generates the ramp voltages (RAMP-OUT1, RAMP-OUT2 and so forth in FIGS. 7 and 8F) for a plurality of horizontal lines constituting a screen. The ramp voltage generating circuit 25 is supplied with the on/off control signals (SCAN-IN1, SCAN-IN2 and so forth) from the set-up voltage control circuit 57 (FIG. 7), and as described later, performs the switching operation based on these signals and the switching pulses P1, P2. Also, the set-up voltage control circuit 57, based on the scanning voltages SCAN1, SCAN2 and so forth supplied from the scanning driver 2, respectively generates the on/off control signals SCAN-IN1, SCAN-IN2 and so forth supplied to the ramp voltage generating circuit 25.

Assume, for example, that the on/off control signal SCAN-IN1 rises the same way as the scanning voltage SCAN1, and the signal SCAN-IN1 falls a predetermined time behind the scanning voltage SCAN1, as shown in FIGS. 8B and 8C. As a result, though not described in detail here, a plurality of ramp voltages out of phase with each other as shown in FIG. 8F are generated from the ramp voltage RAMP-IN shown in FIG. 8A. Each ramp voltage is supplied to each pixel of each horizontal line.

Incidentally, each circuit, each driver and the organic EL display shown in FIG. 6 are connected to a power circuit (not shown).

Figure 10:
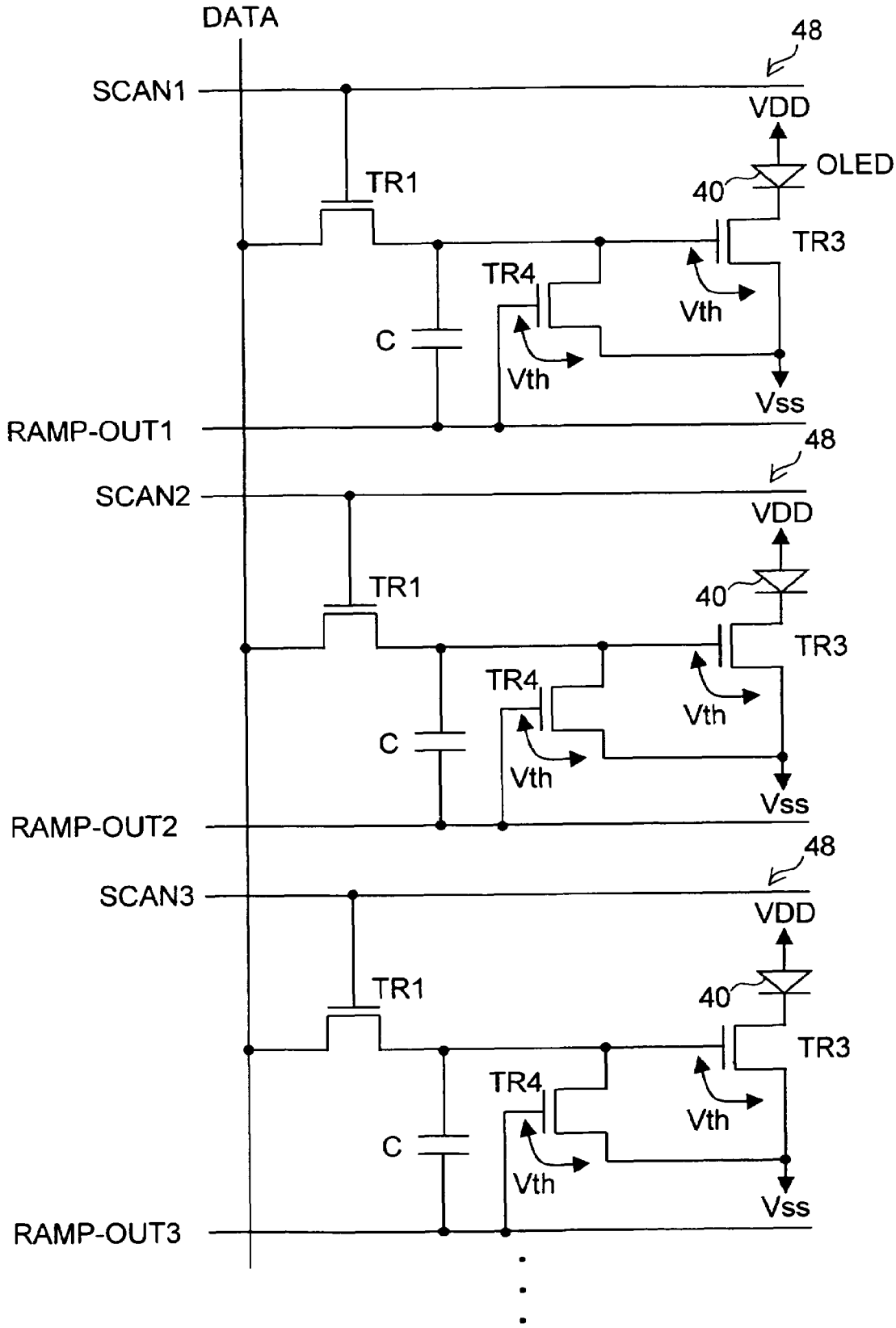
FIG. 10 is a circuit diagram showing a configuration of pixels on a display panel shown in FIG. 6.

(FIG. 10: Description of Pixels)

The display panel 24 is composed of a plurality of pixels 48 having the circuit configuration shown in FIG. 10 arranged in matrix. FIG. 10 shows pixels 48 on the first to third horizontal lines (corresponding to SCAN1 to SCAN3).

Each pixel 48 includes an organic EL element 40 as a display element for emitting light upon receipt of power, a drive transistor TR3 for controlling the energization of the organic EL element 40 in accordance with a voltage that is applied to the gate thereof in accordance with the sum of the data voltage and the ramp voltage supplied from the ramp voltage generating circuit 25, a write transistor TR1 constituting a write element turned on upon application of the scanning voltage (one of SCAN1, SCAN2, SCAN3 and so forth) to the gate thereof from the scanning driver 2, a capacitor C fed with the data voltage (DATA) from the data driver 3 when the write transistor TR1 is in an on state, and a cut-off transistor TR4 turned on for turning off the drive transistor TR3 upon application to the gate thereof of the ramp voltage (one of RAMP-OUT1, RAMP-OUT2, RAMP-OUT3 and so forth) supplied from the ramp voltage generating circuit 25.

The pixels 48 shown in FIG. 10 are similar to each other, and therefore, a detailed description is made with reference to the pixel 48 on the first horizontal line (corresponding to the scanning voltage SCAN1) arranged at the top of FIG. 10. An end of the organic EL element 40 is fed with a high-potential source voltage VDD, and the other end thereof is connected to the drain of the drive transistor TR3. One of the electrodes (e.g., source) of the write transistor TR1 is connected with the data driver 3, and the other electrode (e.g., drain) of the write transistor TR1 is connected to an end of the capacitor C and to both the gate of the drive transistor TR3 and the drain of the cut-off transistor TR4.

The gate of the cut-off transistor TR4 and the other end of the capacitor C, which are connected to the output terminal of the ramp voltage generating circuit 25, are fed with the ramp voltage RAMP-OUT1. Also, the source of the cut-off transistor TR4 and the source of the drive transistor TR3 are supplied with a low-potential reference voltage Vss. The gate of the write transistor TR1 is supplied with the scanning voltage SCAN1 from the scanning driver 2.

In the organic EL display apparatus described above, the write transistor TR1 constituting each pixel 48 for each horizontal line is fed with the scanning voltage SCAN1 or the like from the scanning driver 2, and the corresponding write transistor TR1 is turned on. As a result, the data voltage from the data driver 3 is applied to and accumulated as charge in the capacitor C. The capacitor C has the function as a voltage holding unit to hold the data voltage.

In each pixel 48, as long as the write transistor TR1 is in on state, the drive transistor TR3 is kept off. Once the write transistor TR1 that has thus far been in on state is turned off, the sum of the output voltage of the capacitor C and the variation in the ramp voltage (RAMP-OUT1 or the like) after the turning-off of the write transistor TR1 is applied to the gate of the drive transistor TR3 based on the reference voltage Vss. In the case where the sum voltage exceeds the threshold level Vth of the gate-source voltage of the drive transistor TR3, the drive transistor TR3 is turned on and power is supplied to the organic EL element 40 from the power source voltage VDD so that the organic EL element 40 emits light.

In the case where the ramp voltage (RAMP-OUT1 or the like) based on the reference voltage Vss exceeds the threshold level Vth of the gate-source voltage of the cut-off transistor TR4, the cut-off transistor TR4 turns on. As a result, the drive transistor TR3 is forcibly turned off and therefore the organic EL element 40 fails to emit light.

The drive transistor TR3 and the cut-off transistor TR4 that constitute a pair are located in proximity to each other in a single pixel and formed at the same time by the same fabrication process. Therefore, similar variations occur in characteristics. For example, the threshold level Vth of the gate-source voltage of both the drive transistor TR3 and the cut-off transistor TR4 become substantially equal to each other.

Assume that with the monotonic increase in the ramp voltage, the drive transistor TR3 is turned on first, followed by the turning on of the cut-off transistor TR4. Then, even in the case where the variations and the resultant turning on of the drive transistor TR3 cause the shifting of the time point of luminescence from the organic EL element 40, the subsequent turning off of the drive transistor TR3 by the cut-off transistor TR4 shifts the cessation of luminescence of the organic EL element 40 in the same direction by the same amount. As a result, the duration from the luminescence of the organic EL element 40 by the drive transistor TR3 to the cessation of luminescence of the organic EL element 40 upon turning on of the cut-off transistor TR4 corresponds to the data voltage regardless of the characteristics variations of the transistors TR3, TR4. The drive transistor TR3 and the cut-off transistor TR4 have the function as a drive circuit for supplying power to the organic EL element 40 in accordance with the data voltage.

With this configuration, the drive transistor TR3 is kept on and the organic EL element 40 energized only during the period proportional to the magnitude of the data voltage. Specifically, the organic EL element 40 of each pixel 48 emits light only during the period proportional to the magnitude of the data voltage for each pixel 48.

As described above, the pixel 48 requires no comparator 43 of the pixel 42 in the first embodiment (FIG. 4). This comparator consumes comparatively large power and has a large circuit scale. The display panel 24 according to this embodiment, therefore, can be implemented with a low power consumption and a compact circuit as compared with the display panel 4 of the first embodiment.

On the other hand, assume that the ramp voltage generating circuit 25 is replaced by the ramp voltage generating circuit 5 shown in FIG. 2 to drive the pixels 48. The inconveniences mentioned below may occur. Specifically, assume that the power source voltage VDD is 5 V, the reference voltage Vss is 0 V and the threshold level Vth is 1 V. In order to maximize (lengthen to maximum) the luminescence of the organic EL element 40, the capacitor C is required to be supplied with the data voltage of 1 V when the write transistor TR1 of each pixel 48 turns on. In other words, the width of the data voltage supplied by the data driver 3 is required to be set to −2 V to 1V, for example. This limits the data voltage output from the data driver 3, and may cause an obstacle to the design of the organic EL display.

(FIGS. 7 and 8: Description of Operation)

The ramp voltage generating circuit 25 according to this embodiment, therefore, is configured as shown in FIG. 7. FIG. 7 shows the ramp voltage generating circuit 25 and the set-up voltage control circuit 57. In FIG. 7, the component parts similar or identical to those in FIG. 2 are designated by the same reference numerals, respectively, and not described again.

The voltage generating circuit portion 50 shown in FIG. 7 is similar to the one shown in FIG. 2. Each power supply line 56, however, is fed with the power source voltage V1 output from the set-up voltage control circuit 57.

The set-up voltage control circuit 57, based on the scanning voltages SCAN1, SCAN2, SCAN3 and so forth output from the scanning driver 2, supplies the on/off control signals SCAN-IN1, SCAN-IN2, SCAN-IN3 and so forth to each third switching element SW3. The on/off control signal SCAN-IN1, for example, rises in the same way as the scanning voltage SCAN1 as shown in FIGS. 8B and 8C. Also, the signal SCAN-IN1 falls a predetermined time later than the scanning voltage SCAN1.

Thus, one of the on/off control signals SCAN-IN1, SCAN-IN2, SCAN-IN3 and so forth with the H-level period thereof shifted by one horizontal scanning period 1H as shown in FIG. 8C is supplied to each third switching element SW3 of the ramp voltage generating circuit 25 from the scanning driver 2. Thus, each third switching element SW3 is turned on during the H-level period of the corresponding on/off control signal. As a result, the on-period of each third switching element SW3 is shifted by one horizontal scanning period 1H.

The ramp voltage RAMP-IN falling during the blanking period with the period nH equal to an integer multiple of the horizontal scanning period 1H is supplied from the D/A converter 9 to the ramp voltage generating circuit 25 as shown in FIG. 8A.

The first switching pulse P1 which is at L level during the blanking period when the ramp voltage RAMP-IN falls and at H level during other than the blanking period, as shown in FIG. 8D, is supplied from the timing signal generating circuit 7 to the first switching element SW1. The first switching element SW1 is in an on state during the period when the switching pulse P1 is at H level. The second switching element SW2, on the other hand, is supplied with the second switching pulse P2 which is at H level during the blanking period when the ramp voltage RAMP-IN falls and at L level during other than the blanking period as shown in FIG. 8D. The second switching element SW2 is in an on state during the period when the switching pulse P2 is at H level.

(FIG. 9: Enlarged View of FIG. 8)

FIGS. 9A to 9F are respectively partial views of the waveform diagrams shown in FIGS. 8A to 8F, showing, in a temporally enlarged form, the period in which the scanning voltage SCAN1 is at H level. The period in which the scanning voltage SCAN2 or the like is at H level, if enlarged, is similar to FIGS. 9A to 9F.

Figures 9A, 9B, 9C, 9D, 9E, 9F:
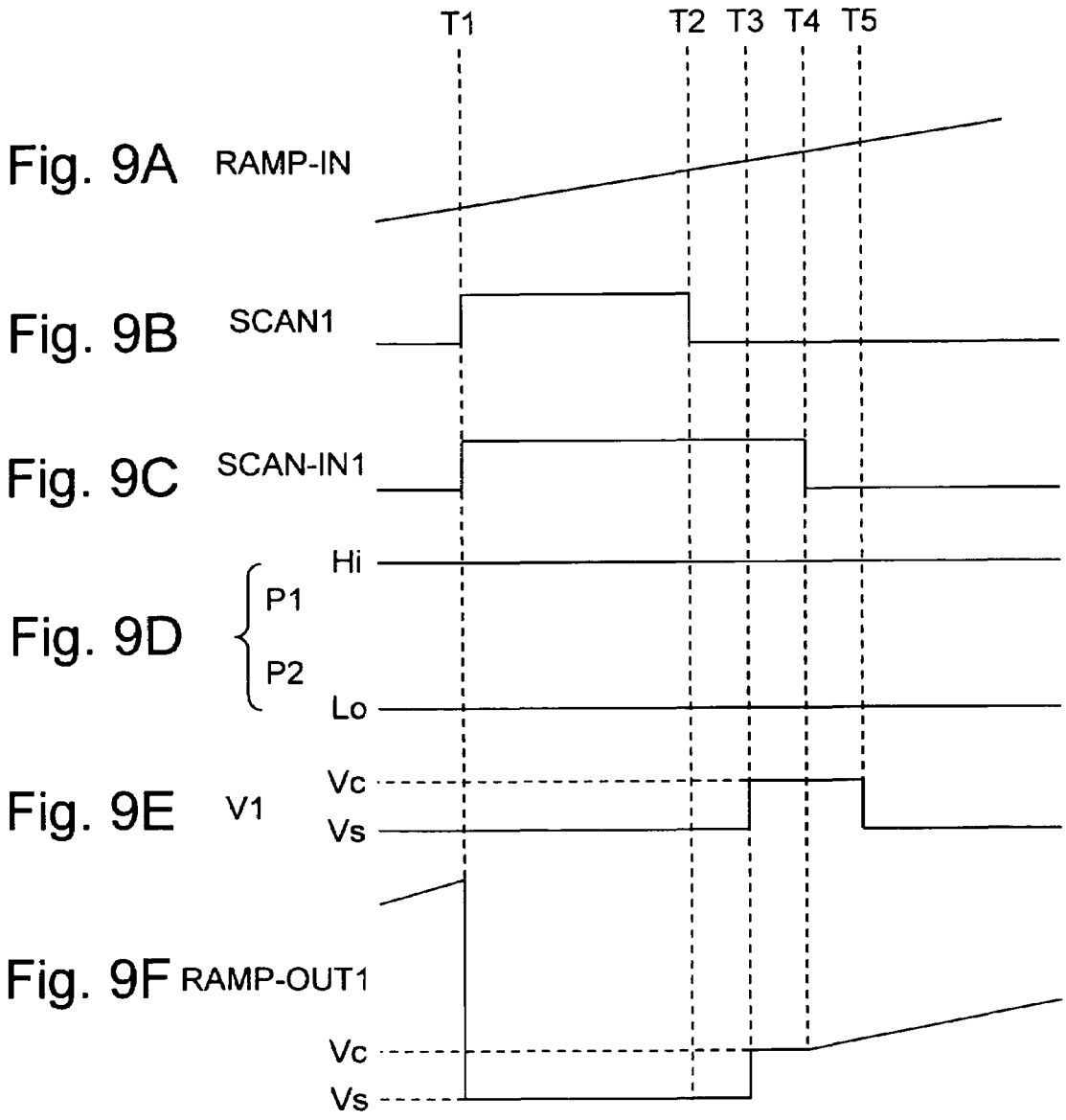
FIGS. 9A to 9F are partly enlarged views of the waveform diagrams shown in FIGS. 8A to 8F.

In the first voltage generating circuit portion 50 connected to the first horizontal line, the scanning voltage SCAN1 rises to H level at timing T1, and at the same time the on/off control signal SCAN-IN1 for the third switching element SW3 corresponding to the first horizontal line rises to H level from L level. In the process, the switching pulses P1, P2 are at H and L level, respectively, as shown in FIGS. 8D and 9D. Therefore, the first switching element SW1 and the second switching element SW2 are in on and off state, respectively. At the same time, the power source voltage V1, as shown in FIGS. 8E and 9E, takes the first power source voltage Vs. The switching pulse P1 and the switching pulse P2 continue to be at H and L levels, respectively, in the same way as at timing T5 described later.

Then, as shown in FIGS. 8C and 9C, the third switching element SW3 turns on in response to the H-level on/off control signal SCAN-IN1, so that the first power source voltage Vs is applied to the output side of the capacitor C of the voltage generating circuit portion 50 and accumulated as charge. In the process, the output voltage RAMP-OUT1 of the operational amplifier 54 takes the same voltage level as the first power source voltage Vs as shown in FIGS. 8F and 9F.

At timing T2, the scanning voltage SCAN1 falls to L level from H level, while the on/off control signal SCAN-IN1 for the third switching element SW3 is kept at H level. The power source voltage V1 is also maintained at the first power source voltage level Vs. Thus, the output voltage RAMP-OUT1 of the operational amplifier 54 still takes the same voltage level as the first power source voltage Vs. Also, the output voltage of the capacitor C of the pixel 48 on the first horizontal line at this timing remains at the data voltage (DATA).

At timing T3, as shown in FIG. 9E, the on/off control signal SCAN-IN1 is at H level, and the set-up voltage control circuit 57 outputs by switching the power source voltage V1 from the first power source voltage Vs to the second power source voltage Vc. Then, the output voltage RAMP-OUT1 of the operational amplifier 54 is also switched from the first power source voltage Vs to the second power source voltage Vc. At this timing, the scanning voltage SCAN1 remains at L level, and therefore the output voltage of the capacitor C of the pixel 48 on the first horizontal line is equal to the sum of the data voltage and the difference (Vc−Vs) between the second power source voltage Vc and the first power source voltage Vs.

At timing T4, as shown in FIGS. 9C and 9E, the power source voltage V1 is maintained at the second power source voltage Vc, while the on/off control signal SCAN-IN1 turns from H to L level. After that, the output voltage RAMP-OUT1 of the operational amplifier 54, as shown in FIG. 9F, gradually increases from the second power source voltage Vc following the input ramp voltage RAMP-IN shown in FIGS. 8A and 9A, applied to the input terminal of the capacitor C of the voltage generating circuit portion 50.

At timing T5, as shown in FIG. 9E, the set-up voltage control circuit 57 outputs by switching the power source voltage V1 from the second power source voltage Vc to the first power source voltage Vs. In the next session, the set-up voltage control circuit 57 switches the power source voltage V1 to the second power source voltage Vc again, as shown in FIGS. 8B, 8C and 8E, when, after the scanning voltage SCAN2 has been turned from H to L level, the on/off control signal SCAN-IN2 remains at H level.

With reference to FIGS. 8A to 8F, the description of the operation of the voltage generating circuit portion 50 connected to the first horizontal line will be continued. During the blanking period when the input ramp voltage RAMP-IN falls, as shown in FIG. 8D, the first switching element SW1 is turned off by the L-level switching pulse P1, while the second switching element SW2 is turned on by the H-level switching pulse P2. Thus, the output voltage RAMP-OUT1 of the operational amplifier 54, as shown in FIG. 8F, is maintained at the voltage value as of the time of the switching of the two switching elements SW1, SW2 regardless of the input ramp voltage RAMP-IN.

After the lapse of the blanking period, as shown in FIG. 8D, the first switching element SW1 is turned on by the H-level switching pulse P1, while the second switching element SW2 is turned off by the L-level switching pulse P2. As a result, the output voltage RAMP-OUT1 of the operational amplifier 54 gradually increases from the aforementioned voltage value following the input ramp voltage RAMP-IN shown in FIG. 8A.

During the blanking period when the input ramp voltage RAMP-IN falls again, like during the aforementioned blanking period, the first switching element SW1 is turned off while the second switching element SW2 is turned on. Thus, the output voltage RAMP-OUT1 of the operational amplifier 54 is maintained at the voltage value as of the time point of the switching of the switching elements SW1, SW2. After the lapse of the blanking period, the first switching element SW1 is turned on while the second switching element SW2 is turned off. As a result, the output voltage RAMP-OUT1 of the operational amplifier 54 gradually increases following the input ramp voltage RAMP-IN from the aforementioned voltage value.

After that, as shown in FIG. 8C, the third switching element SW3 is turned on by the H-level on/off control signal SCAN-IN1, so that the output voltage RAMP-OUT1 of the operational amplifier 54 returns to the same voltage level as the power source voltage V1. In the process, the power source voltage V1 takes the same value as the first power source voltage Vs.

As described above, by controlling the on/off operation of the first to third switching elements SW1 to SW3, as shown in FIG. 8F, the ramp voltage RAMP-OUT1 is output from the operational amplifier 54, which repeats the process of gradually increasing from the second power source voltage Vc following the input ramp voltage RAMP-IN and returning to the first power source voltage value Vs at the time point when the third switching element SW3 is turned on.

Also in each voltage generating circuit portion 50 connected to the last line from the second horizontal line (corresponding to the scanning voltage SCAN2), like in the first voltage generating circuit portion 50 described above, the ramp voltage (one of RAMP-OUT2, RAMP-OUT3 and so forth) is output from the operational amplifier 54, which repeats the process of gradually increasing from the second power source voltage value Vc following the input ramp voltage RAMP-IN, and returning to the first power source voltage value Vs at the time point when the third switching element SW3 is turned on. Since the on-period of the third switching element SW3 is shifted by one horizontal scanning period 1H as described above, the phase of the ramp voltage output from the operational amplifier 54 of each voltage generating circuit portion 50 is shifted by one horizontal scanning period 1H as shown in FIG. 8F.

In the organic EL display apparatus according to this embodiment, as shown in FIG. 8F, a ramp voltage having a gentle slope changing from L to H level over one frame period is supplied to each horizontal line, and therefore substantially the whole of each frame period can be used as the luminescence period.

Also, all the horizontal lines can be scanned using substantially the whole of one frame period, and therefore the scanning rate may be low.

Further, the luminescence time is varied from one pixel to another, the influence of the voltage drop of the power line in the display panel is reduced.

In the organic EL display apparatus according to this embodiment, the counter 8 and the D/A converter 9 are arranged on the system body. The D/A converter and the delay circuit, however, are not required for each horizontal line, nor the low-pass filter is required for each horizontal line. Thus, the circuit configuration of the display apparatus is simplified as a whole. Also, the lack of the low-pass filter in each voltage generating circuit portion 50 of the ramp voltage generating circuit 25 eliminates the influence on the circuits constituting the pixels in subsequent stages.

In the case where the scanning voltage SCAN1 of the first horizontal line rises to H level and the corresponding write transistor TR1 is in on state, the set-up voltage supply circuit 57 turns on the third switching element SW3 of the voltage generating circuit portion 50 connected to the first horizontal line while at the same time outputting the first power source voltage Vs as a power source voltage V1 (timing T1 to T2 in FIGS. 9A to 9F). Even after the scanning voltage SCAN 1 that has thus far been at H level turns to L level and the write transistor TR1 that has thus far been in on state turns off, the on/off control signal SCAN-IN1 of the third switching element SW3 is maintained at H level for a predetermined period of time (from timing T2 to T4 in FIGS. 9A to 9F). Thus, the third switching element SW3 is kept on.

Further, the set-up voltage supply circuit 57 outputs by switching the power source voltage V1 from the first power source voltage Vs to the second power source voltage Vc for the same predetermined period of time (timing T3 in FIGS. 9A to 9F). In the process, the scanning voltage SCAN1 is at L level, and therefore the output voltage (gate voltage of the drive transistor TR3) of the capacitor C of the pixel 48 on the first horizontal line takes a voltage equal to the sum of the data voltage and the difference (Vc−Vs) between the second power source voltage Vc and the first power source voltage Vs.

After the on/off control signal SCAN-IN1 is turned off, the ramp voltage RAMP-OUT1 increases following the rise of the input ramp voltage RAMP-IN applied to the input side of the capacitor C of the voltage generating circuit portion 50. In the case where the voltage increase plus the sum of the data voltage and the difference voltage (Vc−Vs) exceeds the threshold level Vth of the gate-source voltage of the drive transistor TR3, the drive transistor TR3 begins to energize the organic EL element 40. When the ramp voltage RAMP-OUT1 further increases and exceeds the threshold level Vth of the gate-source voltage of the cut-off transistor TR4, the power supplied to the organic EL element 40 is stopped. In this way, the drive transistor TR3 supplies power to the organic EL element 40 in accordance with the data voltage and with the voltage increase (change) of the ramp voltage RAMP-OUT1 when the write transistor TR1 is off.

Thus, the width of the data voltage supplied from the data driver 3 can be set with a larger freedom. Assume that the power source voltage VDD is 5 V, the reference voltage Vss is 0 V and the threshold level Vth (see FIG. 10) is 1 V, for example. To secure maximum (longest) luminescence of the organic EL element 40, the output voltage of the capacitor C (i.e., the gate voltage of the drive transistor TR3) of the particular pixel 48 is required to be 1 V at the timing T4 shown in FIGS. 9A to 9F.

In the case where the width of the data voltage that can be supplied from the data driver 3 is in the range of −5 V to −1 V, e.g., the difference voltage (Vc−Vs) is set to 2 V. This is by reason of the fact that if the data driver 3 outputs the data voltage of −1 V for the pixel 48 of which the maximum (longest) luminescence of the organic EL element 40 is desired, the output voltage of the capacitor C of the particular pixel 48 (i.e., the gate voltage of the drive transistor TR3) takes 1 V at timing T4 (shown in FIGS. 9A to 9F).

The difference voltage (Vc−Vs) is preferably made adjustable by applying an external signal to the set-up voltage control circuit 57 or otherwise. The threshold level Vth is intended to eliminate the variations which normally occur between different sessions of production (production lots) of the display panel 24. As a result, the width of the data voltage supplied from the data driver 3 can be set with greater degree of freedom, and the display quality of the display panel 24 is improved. The variations may of course be eliminated by adjusting one of the first power source voltage Vs and the second power source voltage Vc.

The scanning driver 2, the timing signal generating circuit 7 and the set-up voltage control circuit 57 constitute a control circuit for controlling the operation of the ramp voltage generating circuit 25. This control circuit may be considered to include the data driver 3.

Figure 11:
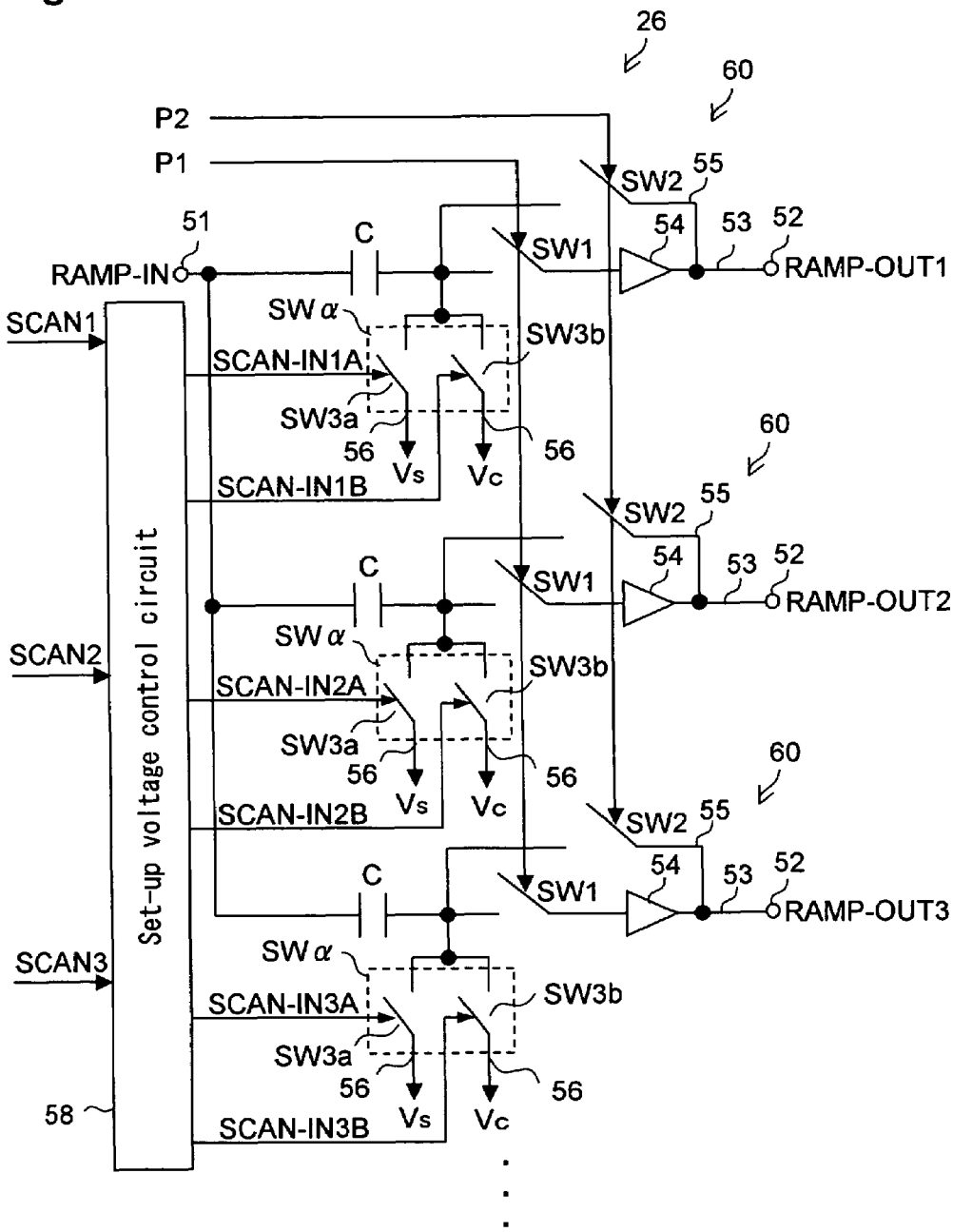
FIG. 11 is a circuit diagram showing a modified version of the set-up voltage control circuit and the ramp voltage generating circuit constituting the organic EL display apparatus shown in FIG. 6.

According to this embodiment, the ramp voltage generating circuit 25 and the set-up voltage control circuit 57 shown in FIGS. 6 and 7 may be replaced with the ramp voltage generating circuit 26 and the set-up voltage control circuit 58, respectively, shown in 11. In FIG. 11, the same component parts as those in FIG. 7 are designated by the same reference numerals, respectively, and not described any more. The ramp voltage generating circuit 26 in FIG. 11 is composed of as many parallel-connected voltage generating circuit portions 60 as the horizontal lines constituting one screen, which portions 60 are connected to the input terminal 51.

In this voltage generating circuit portion 60, the third switching element SW3 in FIG. 7 is replaced with the third switching element SWα. The plurality of voltage generating circuit portions 60 in FIG. 11 are all similar to each other, and therefore the following description is made with reference only to the voltage generating circuit portion 60 on the first horizontal line (corresponding to the ramp voltage RAMP-OUT1) arranged at the top of FIG. 11.

The third switching element SWα is composed of two switches SW3*a*, SW3*b*. The on/off operation of the switches SW3*a*, SW3*b* is controlled by the on/off control signals SCAN-IN1A, SCAN-IN1B produced from the set-up voltage control circuit 58. The switches SW3*a* and SW3*b* are turned on when the on/off control signals SCAN-IN1A and SCAN-IN1B are at H level, respectively. When one of the switches SW3*a*, SW3*b* is turned on, the third switching element SWα is on, while when both the switches SW3*a*, SW3*b* are turned off, the third switching element SWα is off. One terminal each of the switches SW3*a*, SW3*b* is fed with the power source voltages (power circuits thereof are not shown) Vs, Vc, respectively, through the power supply line 56. The other terminal each of the switches SW3*a*, SW3*b* is connected to the connecting point between the capacitor C of the voltage generating circuit portion 60 and one of the terminals of the first switching element SW1.

The set-up voltage control circuit 58, based on the scanning voltages SCAN1, SCAN2, SCAN3 and so forth from the scanning driver 2, supplies the on/off control signal to each third switching element SWα. Specifically, as shown in FIG. 11, the switch SW3*a* constituting the third switching element SWα corresponding to the first horizontal line is supplied with the signal SCAN-IN1A, and the switch SW3*b* constituting the third switching element SWα is supplied with the signal SCAN-IN1B (this is also the same for the second horizontal line, third horizontal line and so forth).

Figures 12A, 12B, 12C, 12D, 12E:
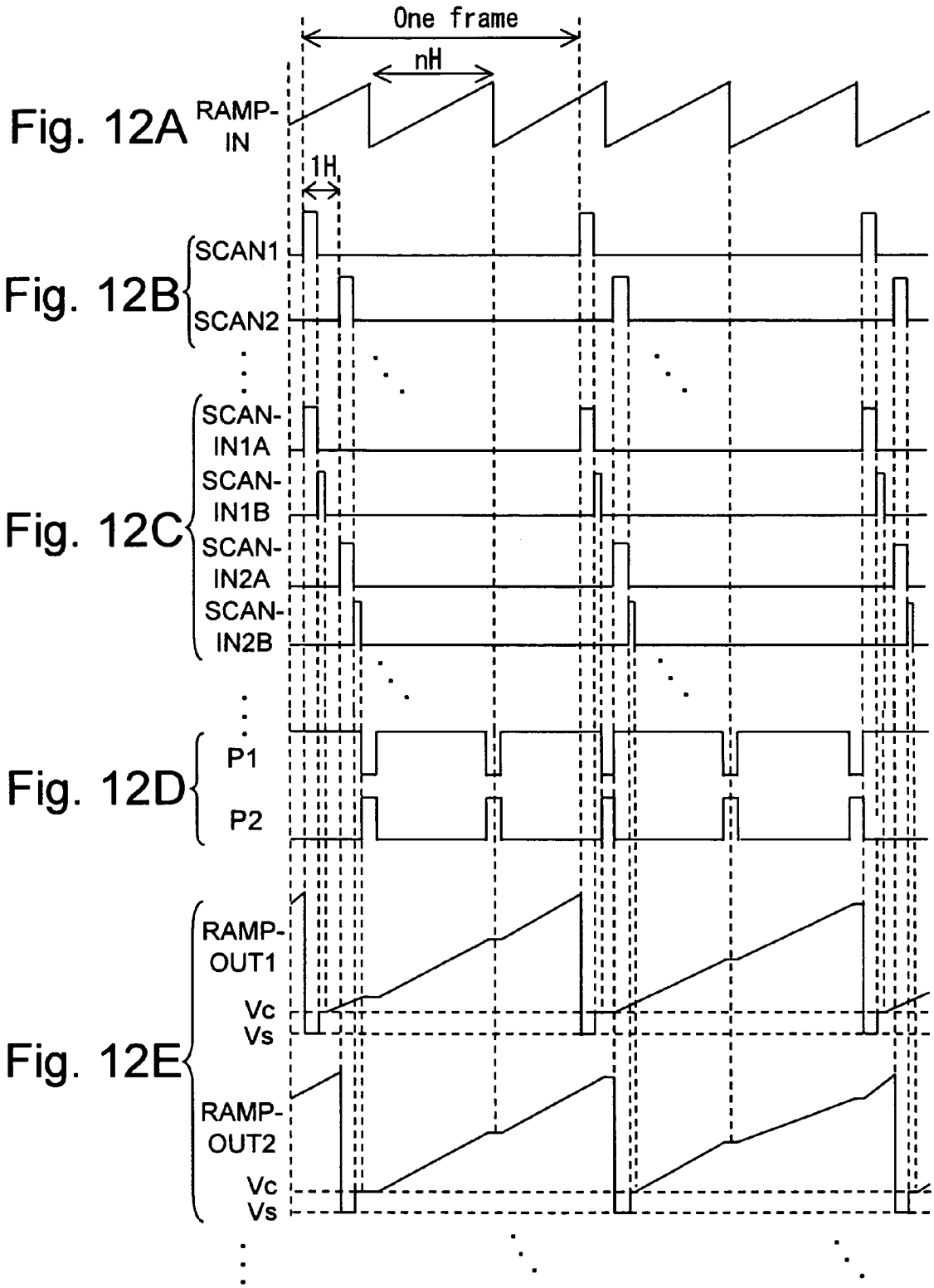
FIGS. 12A to 12E are waveform diagrams showing operations of the set-up voltage control circuit and the ramp voltage generating circuit shown in FIG. 11.
Figure 13:
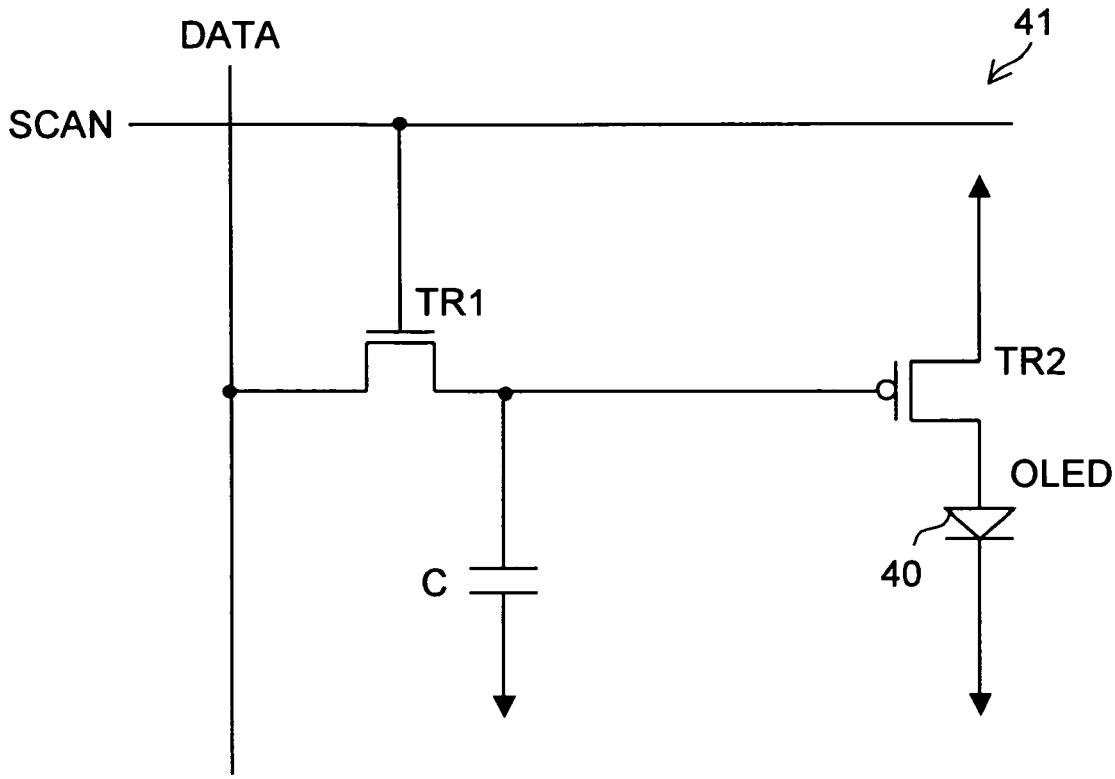
Fig. 13 PRIOR ART
FIG. 13 is a diagram showing a circuit configuration of each pixel constituting a conventional active matrix drive-type organic EL display apparatus.
Figure 14:
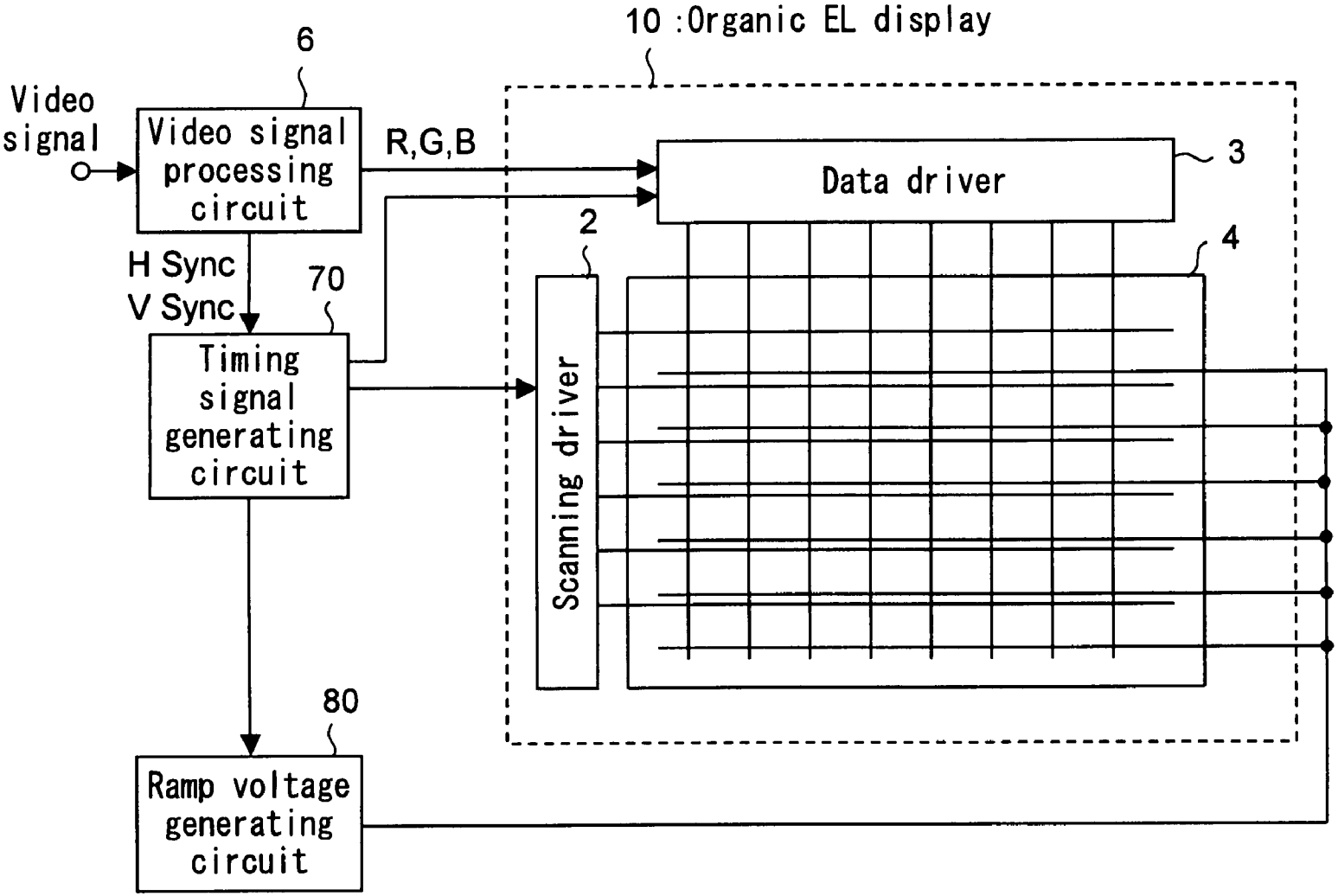
Fig. 14 PRIOR ART
FIG. 14 is a block diagram showing a configuration of a conventional EL display apparatus proposed by the present applicant.

The signal SCAN-IN1A, as shown in FIGS. 12B and 12C, rises to H level in synchronism with the rise of the scanning voltage SCAN1, and falls to L level in synchronism with the fall of the scanning signal SCAN1. The signal SCAN-IN1B, on the other hand, rises to H level in synchronism with the fall of the signal SCAN-IN1A, and falls to L level before the rise time point of the scanning voltage SCAN2. In FIG. 12, the relation between the scanning voltage SCAN1 or the like (FIG. 12B) and the ramp voltage RAMP-IN (FIG. 12A) and the first and second switching pulses P1, P2 (FIG. 12D) is similar to the corresponding relation in FIGS. 8A, 8B and 8D.

Even after modification of the second embodiment in the manner described above, as shown in FIG. 12E, the ramp voltage RAMP-OUT1 and the like generated by the ramp voltage generating circuit 26 is similar to the ramp voltage RAMP-OUT1 and the like generated by the ramp voltage generating circuit 25 shown in FIG. 8F, and therefore the functions and effects described above are realized.

After the above-mentioned modification, the scanning driver 2, the timing signal generating circuit 7, the set-up voltage control circuit 58 and a power circuit, not shown, for supplying the power source voltage Vs and the power source voltage Vc constitute a control circuit for controlling the operation of the ramp voltage generating circuit 26. This control circuit is considered to further include the data driver 3.

Variations and Modifications

Also in the second embodiment, the modification described with reference to FIGS. 5A to 5E can be employed. Specifically, the phase of the ramp voltage can be shifted for each three horizontal lines by the time required for scanning the three horizontal lines. In the configuration for shifting the phase of the ramp voltage by three horizontal lines, the ramp voltage generating circuit is so configured that a plurality of parallel-connected voltage generating circuits as many as one third of the number of horizontal lines constituting one screen are connected to the voltage input terminal. The set-up voltage control circuit, based on the scanning voltage from the scanning driver, generates switching pulses with the H-level period thereof shifted by the time required for scanning three horizontal lines, and each of the switching pulses is supplied to each third switching element SW3.

Also, the ramp voltage (RAMP-OUT1 or the like) output from the ramp voltage generating circuit 25 according to the second embodiment may be applied to the display panel 4 according to the first embodiment.

The embodiments of the present invention have been described above with reference to the ramp voltage RAMP-IN adapted to increase at a predetermined rate (e.g., 1 V/msec) with time (except for the blanking period). As an alternative, it is of course possible to employ the ramp voltage RAMP-IN adapted to decrease at a predetermined rate (e.g., −1 V/msec) with time (except for the blanking period). In such a case, each circuit is changed appropriately (e.g., the drive transistor TR3 shown in FIG. 10 is changed to p-channel type).

Naturally, in the case where the ramp voltage RAMP-IN increasing with time (except for the blanking period) is employed, the ramp voltage RAMP-IN falls during the blanking period, while when the ramp voltage RAMP-IN decreasing with time (except for the blanking period) is employed, on the other hand, the ramp voltage RAMP-IN rises during the blanking period.

FIG. 10 illustrates a circuit configuration of the pixels with the cathode of the organic EL element 40 connected to the drain of the drive transistor TR3. This circuit configuration of the pixels 48, however, is only an example shown to facilitate understanding and the present invention is not limited to this example. In the case where the reference voltage Vss is required to be directly applied to the cathode of the organic EL element 40 for reasons of the characteristics or fabrication of the organic EL element 40, e.g., the circuit configuration is changed, for example, by replacing the drive transistor TR3 shown in FIG. 10 with p-channel type, and so forth (the cut-off transistor TR4 or the like is also changed at the same time).

What is claimed is:

1. A ramp voltage generating apparatus comprising:

a voltage output circuit for outputting a ramp voltage;

a ramp voltage generating circuit for generating a plurality of ramp voltages out of phase with each other from the ramp voltage; and a control circuit for controlling an operation of the ramp voltage generating circuit, wherein the ramp voltage generating circuit includes a plurality of voltage generating circuit portions connected in parallel to a voltage input terminal to be supplied with the ramp voltage output from the voltage output circuit, each of the voltage generating circuit portions includes:

a voltage output terminal;

a capacitor arranged on a line extending from the voltage input terminal to the voltage output terminal;

an amplifier arranged on the portion of the line closer to the voltage output terminal than to the capacitor;

a first switching element interposed between the capacitor and the amplifier on the line;

a second switching element arranged on a feedback line connecting a output terminal of the amplifier and a connecting point of the capacitor and the first switching element; and a third switching element arranged on a power supply line connected to the connecting point, the control circuit turns on the third switching elements of the plurality of voltage generating circuit portions while shifting the time point of switching each of the third switching elements from off to on state, and the control circuit turns off the first switching elements and, also, turns on the second switching elements of the plurality of voltage generating circuit portions during the period including the fall time point and the rise time point of the ramp voltage input to the voltage input terminal.

2. The ramp voltage generating apparatus according to claim 1, wherein the control circuit can output and supply a first power source voltage or a second power source voltage to each connecting point through the power supply line connected to each third switching element of each voltage generating circuit portion when the third switching element is in an on state, and the control circuit outputs the first power source voltage during part of the on-period of each third switching element and, also, outputs the second power source voltage during the period including the time point of turning each third switching element from on to off state.

3. The ramp voltage generating apparatus according to claim 1, wherein the control circuit controls the on/off operation of the second switching element and the third switching element in such a manner that the on-period of the second switching element and the on-period of the third switching element do not overlap.

4. An active matrix drive-type display apparatus comprising a display panel including a plurality of pixels arranged in a matrix, each pixel of the display panel including a display element for emitting light when supplied with power and a drive circuit for comparing a data voltage supplied from outside the pixel with a ramp voltage and supplying power to the display element in accordance with the result of comparison, wherein the display apparatus comprises:

a voltage output circuit for outputting the ramp voltage;

a ramp voltage generating circuit for generating ramp voltages for a plurality of horizontal lines constituting one screen based on the ramp voltage output from the voltage output circuit; and a control circuit for controlling an operation of the ramp voltage generating circuit, the ramp voltage generating circuit includes a plurality of voltage generating circuit portions connected in parallel to a voltage input terminal to be supplied with the ramp voltage output from the voltage output circuit, each of the voltage generating circuit portions includes:

a voltage output terminal connected to pixels on one or more horizontal lines;

a capacitor arranged on a line extending from the voltage input terminal to the voltage output terminal;

an amplifier arranged on the portion of the line closer to the voltage output terminal than to the capacitor;

a first switching element interposed between the capacitor and the amplifier on the line;

a second switching element arranged on a feedback line connecting a output terminal of the amplifier and a connecting point of the capacitor and the first switching element; and a third switching element arranged on a power supply line connected to the connecting point, the control circuit turns on the third switching elements of the plurality of voltage generating circuit portions while shifting the time point of switching each of the third switching elements from off to on state, and the control circuit turns off the first switching elements and, also, turns on the second switching elements of the plurality of voltage generating circuit portions during the period including the fall time point and the rise time point of the ramp voltage input to the voltage input terminal.

5. The active matrix drive-type display apparatus according to claim 4, wherein the control circuit includes a scanning driver and a data driver connected to the display panel, each pixel of the display panel includes a write element turned on upon application thereto of a scanning voltage from the scanning driver, and a voltage holding unit for holding the data voltage applied thereto from the data driver when the write element is in an on state, the drive circuit compares the output voltage of the voltage holding unit with the ramp voltage generated by the ramp voltage generating circuit, and the third switching element of each of the voltage generating circuit portions is turned on/off in accordance with the scanning voltage from the scanning driver.

6. The active matrix drive-type display apparatus according to claim 4, wherein the control circuit includes a scanning driver and a data driver connected to the display panel, each pixel of the display panel includes a write element turned on upon application thereto of a scanning voltage from the scanning driver, and a voltage holding unit for holding a data voltage applied thereto from the data driver when the write element is in an on state, the drive circuit compares the output voltage of the voltage holding unit with the ramp voltage generated by the ramp voltage generating circuit, the third switching element of each of the voltage generating circuit portions is turned on/off in accordance with an on/off control signal, and the ramp voltage generating circuit generates the on/off control signal for the third switching element of each of the voltage generating circuit portions based on the scanning voltage from the scanning driver.

7. The active matrix drive-type display apparatus according to claim 4, wherein the ramp voltage output from the voltage output circuit falls or rises during a blanking period with a cycle equal to an integer multiple of one horizontal scanning period or one vertical scanning period.

8. The active matrix drive-type display apparatus according to claim 5, wherein the ramp voltage output from the voltage output circuit falls or rises during a blanking period with a cycle equal to an integer multiple of one horizontal scanning period or one vertical scanning period.

9. An active matrix drive-type display apparatus comprising a display panel including a plurality of pixels arranged in a matrix, each pixel of the display panel including a display element for emitting light when supplied with power and a drive circuit for supplying power to the display element in accordance with a data voltage supplied from outside the pixel, wherein the display apparatus comprises:

a voltage output circuit for outputting a ramp voltage;

a ramp voltage generating circuit for generating ramp voltages for a plurality of horizontal lines constituting one screen based on the ramp voltage output from the voltage output circuit; and a control circuit for controlling an operation of the ramp voltage generating circuit, the ramp voltage generating circuit includes a plurality of voltage generating circuit portions connected in parallel to a voltage input terminal to be supplied with the ramp voltage output from the voltage output circuit, each of the voltage generating circuit portions includes:

a voltage output terminal connected to pixels on one or more horizontal lines;

a capacitor arranged on a line extending from the voltage input terminal to the voltage output terminal;

an amplifier arranged on the portion of the line closer to the voltage output terminal than to the capacitor;

a first switching element interposed between the capacitor and the amplifier on the line;

a second switching element arranged on a feedback line connecting a output terminal of the amplifier and a connecting point of the capacitor and the first switching element; and a third switching element arranged on a power supply line connected to the connecting point, the control circuit turns on the third switching elements of the plurality of voltage generating circuit portions while shifting the time point of switching each of the third switching elements from off to on state, and the control circuit turns off the first switching elements and, also, turns on the second switching elements of the plurality of voltage generating circuit portions during the period including the fall time point and the rise time point of the ramp voltage input to the voltage input terminal.

10. The active matrix drive-type display apparatus according to claim 9, wherein the control circuit includes a scanning driver and a data driver connected to the display panel, each pixel of the display panel includes a write element turned on upon application thereto of a scanning voltage from the scanning driver, and a voltage holding unit for holding the data voltage applied thereto from the data driver when the write element is in an on state, the drive circuit supplies power to the display element in accordance with the data voltage held by the voltage holding unit and the ramp voltage generated, when the write element is in an off state, by the ramp voltage generating circuit, and the control circuit can output and supply a first power source voltage or a second power source voltage to each connecting point through the power supply line connected to each third switching element of each voltage generating circuit portion when the third switching element is turned on; turns on the third switching element of the voltage generating circuit portion having the voltage output terminal connected to the pixel having the write element in the on state and, also, outputs the first power source voltage when the write element of the pixel is in the on state; and after the write element is turned from on to off state, keeps the third switching element on for a predetermined period of time and switches the output voltage from the first power source voltage to the second power source voltage during the predetermined period of time.

11. The active matrix drive-type display apparatus according to claim 10, wherein a difference voltage between the first power source voltage and the second power source voltage is adjustable.

* * * * *